US010461400B2

(12) United States Patent
Gang et al.

(10) Patent No.: US 10,461,400 B2
(45) Date of Patent: Oct. 29, 2019

(54) HOUSING INCLUDING ANTENNA, MANUFACTURING METHOD OF HOUSING, AND ELECTRONIC DEVICE HAVING HOUSING

(71) Applicant: Samsung Electronics Co., Ltd., Gyeonggi-do (KR)

(72) Inventors: Gi-Uk Gang, Gyeonggi-do (KR); Byeonghwan Youm, Gyeonggi-do (KR); Kyung Bin Kim, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 170 days.

(21) Appl. No.: 15/255,568

(22) Filed: Sep. 2, 2016

(65) Prior Publication Data

US 2017/0084986 A1 Mar. 23, 2017

(30) Foreign Application Priority Data

Sep. 23, 2015 (KR) ..... 10-2015-0134934

(51) Int. Cl.
*H01Q 1/24* (2006.01)
*H01Q 9/42* (2006.01)
*H01Q 5/371* (2015.01)

(52) U.S. Cl.
CPC ..... *H01Q 1/243* (2013.01); *H01Q 5/371* (2015.01); *H01Q 9/42* (2013.01)

(58) Field of Classification Search
CPC ..... H01Q 1/243; H01Q 1/38; H01Q 9/0421
USPC ..... 343/702, 872, 878
See application file for complete search history.

(56) References Cited

U.S. PATENT DOCUMENTS

2012/0235879 A1* 9/2012 Eder ..... H01Q 1/243 343/873
2013/0021212 A1* 1/2013 Lai ..... H01Q 1/243 343/702
2013/0147675 A1* 6/2013 Kato ..... H01Q 1/38 343/788
2014/0285393 A1* 9/2014 Biglarbegian ..... H01P 5/107 343/850
2015/0138024 A1* 5/2015 Kalistaja ..... H01Q 1/36 343/702

FOREIGN PATENT DOCUMENTS

KR 1020100062553 6/2010
KR 101137988 4/2012
WO WO 2013035932 3/2013

* cited by examiner

*Primary Examiner* — Dameon E Levi
*Assistant Examiner* — Collin Dawkins
(74) *Attorney, Agent, or Firm* — The Farrell Law Firm, P.C.

(57) ABSTRACT

Disclosed is an electronic device having a housing and including an antenna device, and a method of manufacturing the housing. When the antenna device requiring a plating process is applied to the housing, the housing has an antenna and provides exterior deposition and visual enhancement to the electronic device.

4 Claims, 17 Drawing Sheets

HOUSING INCLUDING ANTENNA, MANUFACTURING METHOD OF HOUSING, AND ELECTRONIC DEVICE HAVING HOUSING

PRIORITY

This application claims priority under 35 U.S.C. § 119(a) to a Korean Patent Application, which was filed in the Korean Intellectual Property Office on Sep. 23, 2015 and assigned Serial No. 10-2015-0134934, the contents of which are incorporated herein by reference.

BACKGROUND

1. Field of the Disclosure

The present disclosure relates generally to an electronic device, and more particularly, to a housing including an antenna, a method of manufacturing the housing, and an electronic device including the housing.

2. Description of the Related Art

Recently, electronic devices have been decreased in size while being improved in rigidity and strength. An electronic device generally includes one or more antenna devices which should be essentially provided for communication, among the components thereof.

A housing for an electronic device, which is typically formed by a dual injection molding, may be manufactured by injection-molding a base and a case, forming an antenna region and a pattern on a surface of the base, and then performing a painting process on the pattern.

A laser direct structuring in-mold (LDSI) method may be used in which a carrier, which is completed by forming an antenna radiation pattern on a surface of a first non-conductive structure, is inserted into a mold and a second non-conductive structure is injection molded such that at least a portion of the antenna pattern is positioned between the first non-conductive structure and the second non-conductive structure.

However, the antenna device having an antenna pattern applied to the above-mentioned dual injection molding structure, suffers from degradation in radiation function due to the crack and/or loss of the antenna radiation pattern, and after the dual injection molding, it becomes very difficult to perform deposition on the exterior of the housing due to the contact of a chemical material during a plating process which may be performed.

As such, there is a need in the art for an improved housing for an electronic device, and an improved method of manufacturing the housing, such that deposition on the housing exterior is facilitated.

SUMMARY

Accordingly, the present disclosure has been made to address at least the problems and/or disadvantages described above and to provide at least the advantages described below.

Accordingly, an aspect of the present disclosure is to provide a provide a housing including an antenna, a method of manufacturing the housing, and an electronic device including the housing.

According to another aspect of the present disclosure, when an antenna device requiring a plating process, is applied to a housing, the housing has an antenna and enables exterior deposition.

According to another aspect of embodiments of the present disclosure, an electronic device comprises a housing that includes a first non-conductive structure including a first surface and a side surface having a height in at least a partial region along a rim of the first surface, a conductive pattern disposed to extend from the first surface of the first non-conductive structure to at least a partial region of the second surface that is opposite to the first surface, and a second non-conductive structure formed on the first non-conductive structure through in-mold injection molding, wherein the conductive pattern extends to the second surface without overlapping with the second non-conductive structure.

According to another aspect of embodiments of the present disclosure, a method of manufacturing a housing includes forming a conductive pattern on a first non-conductive structure, injection molding a second non-conductive structure on the first non-conductive structure, masking a region including the conductive pattern, performing deposition on at least a partial region of the second non-conductive structure, and removing the masking region and performing post-treatment, wherein the conductive pattern extends to the second surface of the first non-conductive structure without overlapping the second non-conductive structure.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION OF EMBODIMENTS OF THE DISCLOSURE

Figure 1:
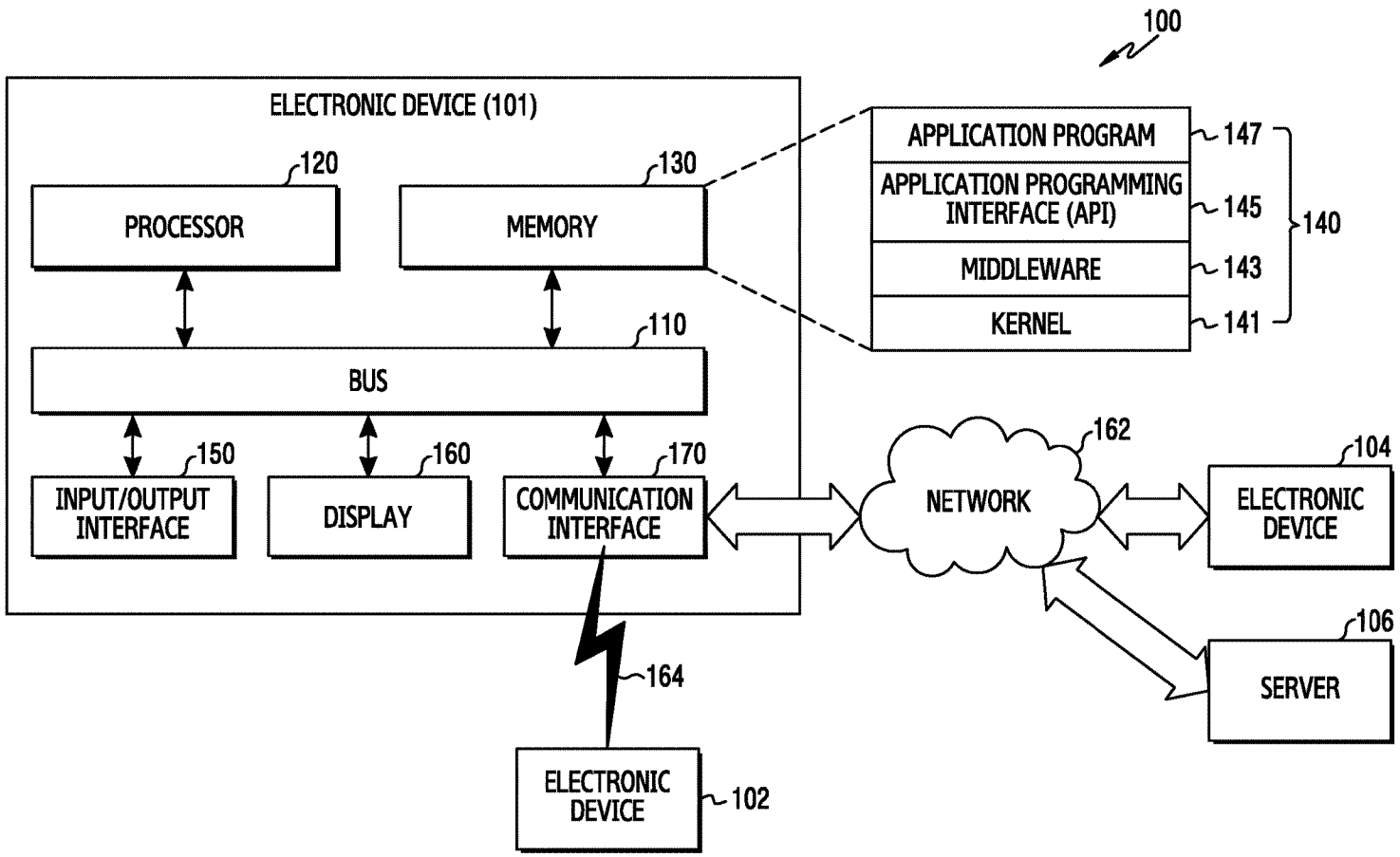
FIG. 1 illustrates a network environment that includes an electronic device according to embodiments of the present disclosure.

Various embodiments of the present invention will now be described in detail with reference to the accompanying drawings. The description includes various specific details to assist in that understanding, but these details are examples, and those of ordinary skill in the art will recognize that various changes and modifications of the embodiments described herein can be made without departing from the scope and spirit of the present disclosure. In addition, descriptions of well-known functions and constructions may be omitted for the sake of clarity and conciseness.

The terms and words used in the following description and claims are not limited to their dictionary meanings, but are used to enable a clear and consistent understanding of the present disclosure. Accordingly, it should be apparent to those skilled in the art that the following description of embodiments of the present disclosure is provided for illustration purposes only and not for the purpose of limiting the present disclosure as defined by the appended claims and their equivalents.

Herein, singular forms such as "a," "an," and "the" include plural references unless the context clearly dictates otherwise. Thus, reference to "a component surface" includes reference to one or more of such surfaces.

The expression "substantially" indicates that the recited characteristic, parameter, or value need not be achieved exactly, but that deviations or variations, including, for example, tolerances, measurement error, measurement accuracy limitations and other factors known to those of skill in the art, may occur in amounts that do not preclude the effect the characteristic was intended to provide.

The expressions "have," "may have," "include," and "may include" indicate the presence of corresponding features, numbers, functions, parts, operations, elements, etc., but do not limit additional one or more features, numbers, functions, parts, operations, elements, etc.

The expressions "A or B," "at least one of A or/and B", and "one or more of A or/and B" include any and all combinations of words enumerated with it. For example, "A or B," "at least one of A and B", and "at least one of A or B" describe (1) including A, (2) including B, or (3) including both A and B.

Although recitations, such as "first" and "second" as used herein may modify various elements of embodiments of the present disclosure, these terms do not limit the corresponding elements. For example, these recitations do not limit an order and/or importance of the corresponding elements, and may be used for the purpose of distinguishing one element from another element. For example, a first user device and a second user device both indicate user devices and may indicate different user devices. A first element may be referred to as a second element without departing from the scope of the present disclosure, and similarly, a second element may be referred to as a first element.

When an element, such as a first element, is "connected to" or "operatively or communicatively coupled with/to" another element, such as a second element, the first element may be directly connected or coupled to the second element, or there may be an intervening element, such as a third element, between the first and second elements. However, when the first element is "directly connected" or "directly coupled" to the second element, there is no intervening third element between the first and second elements.

The expression "configured to (or set to)" may be used interchangeably with "suitable for," "having the capacity to," "designed to," "adapted to," "made to," or "capable of" according to the situation. The term "configured to (or set to)" does not necessarily indicate "specifically designed to" in a hardware level. Instead, the expression "an apparatus configured to . . . " may indicate that the apparatus is "capable of . . . " along with other devices or parts in a certain situation. For example, "a processor configured to (set to) perform A, B, and C" may be a dedicated processor, e.g., an embedded processor, for performing a corresponding operation, or a generic-purpose processor, e.g., a central processing unit (CPU) or an application processor (AP), capable of performing a corresponding operation by executing one or more software programs stored in a memory device.

All the terms used herein, including technical and scientific terms, should be interpreted to have the same meanings as commonly understood by those skilled in the art to which the present disclosure pertains, and should not be interpreted to have ideal or excessively formal meanings, unless explicitly defined herein.

A module or programming module includes at least one constituent element among the described constituent elements of an apparatus, or may omit some of them, or may further include additional constituent elements. Operations performed by a module, programming module, or other constituent elements may be executed in a sequential, parallel, repetitive, or heuristic manner. In addition, some of the operations may be executed in a different order or may be omitted, or other operations may be added.

Herein, an electronic device may be a smart phone, a tablet personal computer (PC), a mobile phone, a video phone, an e-book reader, a desktop PC, a laptop PC, a netbook computer, a workstation, a server, a personal digital assistant (PDA), a portable multimedia player (PMP), a moving picture experts group phase 1 or phase 2 (MPEG-1 or MPEG-2) audio layer 3 (MP3) player, a mobile medical device, a camera, or a wearable device, such as a head-mounted-device (HMD), electronic glasses, electronic clothing, an electronic bracelet, an electronic necklace, an electronic appcessory, an electronic tattoo, a smart mirror, or a smart watch.

An electronic device may also be a smart home appliance, e.g., a television (TV), a digital versatile disc (DVD) player, an audio component, a refrigerator, an air conditioner, a vacuum cleaner, an oven, a microwave oven, a washing machine, an air cleaner, a set-top box, a home automation control panel, a security control panel, a TV box (e.g., Samsung HomeSync®, Apple TV®, or Google TV®), a game console (e.g., Xbox® or PlayStation®), an electronic dictionary, an electronic key, a camcorder, or an electronic frame.

An electronic device may also be medical equipment, such as a mobile blood glucose monitoring device, heart rate monitor, blood pressure monitoring device, or temperature meter, a magnetic resonance angiography (MRA) machine, a magnetic resonance imaging (MRI) machine, a computed tomography (CT) scanner, an ultrasound machine, a navigation device, a global positioning system (GPS) receiver, an event data recorder (EDR), a flight data recorder (FDR), an in-vehicle infotainment device, electronic equipment for a ship, such as a ship navigation equipment and/or a gyrocompass, avionics equipment, security equipment, a head unit for a vehicle, an industrial or home robot, an automated teller machine (ATM), a point of sale (PoS) device, or an Internet of Things (IoT) device, such as a light bulb, various sensors, an electronic meter, a gas meter, a sprinkler, a fire alarm, a thermostat, a streetlamp, a toaster, a sporting equipment, a hot-water tank, a heater, or a boiler.

An electronic device may also be a piece of furniture, a building/structure, an electronic board, an electronic signature receiving device, a projector, and/or various measuring instruments such as a water, electricity, gas, or wave meter.

An electronic device may also be a combination of one or more of the above-mentioned devices. Further, it will be apparent to those skilled in the art that an electronic device is not limited to the above-mentioned examples.

Herein, the term "user" may indicate a person who uses an electronic device or a device such as an artificial intelligence electronic device that uses the electronic device.

An electronic device of a single radio environment can provide long term evolution (LTE) service using circuit switched fall back (CSFB) that determines whether paging information of a circuit switched (CS) service network is received over an LTE network. When receiving a paging signal of the CS service network over the LTE network, the electronic device connects or accesses the CS service network, such as a 2nd generation (2G) or 3rd generation (3G) network, and provides a voice call service. For example, the 2G network includes one or more of a global system for mobile communications (GSM) network and a code division multiple access (CDMA) network. The 3G network includes one or more of a wideband-CDMA (WCDMA) network, a time division-synchronous CDMA (TD-SCDMA) network, and an evolution-data optimized (EV-DO) network.

Alternatively, the electronic device of the single radio environment can provide LTE service using single radio LTE (SRLTE), which determines whether the paging information is received by periodically switching receive antennas to the CS service network, i.e., the 2G/3G network. Upon receiving the paging signal of the CS service network, the electronic device provides the voice call service by connecting the CS service network.

Alternatively, the electronic device of the single radio environment can provide LTE service using single radio dual system (SRDS), which determines whether the paging information is received by periodically switching some receive antennas to the CS service network. Upon receiving the paging signal of the CS service network, the electronic device provides the voice call service by connecting the CS service network.

FIG. 1 illustrates a network environment including an electronic device according to an embodiment of the present disclosure. Referring to FIG. 1, an electronic device 101 includes a bus 110, a processor 120, a memory 130, an input/output interface 150, a display 160, and a communication interface 170. Alternatively, the electronic device 100 can omit at least one of the components and/or include an additional component.

The bus 110 includes a circuit for connecting the components, such as the processor 120, the memory 130, the input/output interface 150, the display 160, and the communication interface 170, and delivering communications therebetween.

The processor 120 includes one or more of a CPU, an AP, and a communication processor (CP). The processor 120 processes an operation or data for control of and/or communication with another component of the electronic device 101.

The processor 120, which may be connected to the LTE network, determines whether a call is connected over the CS service network using caller identification information (e.g., a caller phone number) of the CS service network. For example, the processor 120 receives incoming call information of the CS service network over the LTE network, and being connected to the LTE network, receives incoming call information over the CS service network, such as the SRLTE.

When receiving the incoming call information of the CS service network over the LTE network, the processor 120 obtains caller identification information from the incoming call information. The processor 120 displays the caller identification information on its display 160. The processor 120 determines whether to connect the call based on input information corresponding to the caller identification information displayed on the display 160. For example, when detecting input information corresponding to an incoming call rejection, through the input/output interface 150, the processor 120 restricts the voice call connection and maintains the LTE network connection. When detecting input information corresponding to an incoming call acceptance, through the input/output interface 150, the processor 120 connects the voice call by connecting to the CS service network.

When receiving the incoming call information, such as a CS notification message or a paging request message of the CS service network over the LTE network, the processor 120 obtains caller identification information from the incoming call information. The processor 120 determines whether to connect the call by comparing the caller identification information with a reception control list. For example, when the caller identification information is included in a first reception control list, such as a blacklist, the processor 120 restricts the voice call connection and maintains the connection to the LTE network. For example, when the caller identification information is not included in the first reception control list, the processor 120 connects the voice call by connecting to the CS service network. For example, when the caller identification information is included in a second reception control list, such as a white list, the processor 120 connects the voice call by connecting to the CS service network.

When receiving the incoming call information of the CS service network over the LTE network, the processor 120 transmits an incoming call response message to the CS service network. The processor 120 may suspend the LTE service and receives the caller identification information, such as a CS call setup message from the CS service network. The processor 120 determines whether to connect the call by comparing the caller identification information with the reception control list. For example, when the caller identification information is included in the first reception control list, the processor 120 restricts the voice call connection and resumes the LTE network connection. When the caller identification information is not included in the first reception control list, the processor 120 connects the voice call by connecting to the CS service network. When the caller identification information is included in the second reception control list, the processor 120 connects the voice call by connecting to the CS service network.

The memory 130 includes volatile and/or nonvolatile memory. The memory 130 stores commands or data, such as the reception control list, relating to at least another component of the electronic device 101. The memory 130 stores software and/or a program 140. The program 140 includes a kernel 141, middleware 143, an application programming interface (API) 145, and applications 147. At least some of the kernel 141, the middleware 143, and the API 145 may be referred to as an operating system (OS).

The kernel 141 controls or manages system resources, such as the bus 110, the processor 120, or the memory 130, used for performing an operation or function implemented by the other programs, such as the middleware 143, the API 145, or the applications 147. The kernel 141 provides an interface through which the middleware 143, the API 145, or the applications 147 connects the individual elements of the electronic device 101 to control or manage the system resources.

The middleware 143 functions as an intermediary for the API 145 or the applications 147 to communicate with the kernel 141 and exchange data. In addition, the middleware 143 processes one or more task requests received from the applications 147 according to priorities thereof. For example, the middleware 143 may assign priorities for using the system resources, such as the bus 110, the processor 120, or the memory 130 of the electronic device 101, to at least one of the applications 147. For example, the middleware 143 performs scheduling or load balancing on the one or more task requests by processing the one or more task requests according to the priorities assigned thereto.

The API 145 is an interface through which the applications 147 control functions provided from the kernel 141 or the middleware 143, and includes at least one interface or function for file control, window control, image processing, and text control, for example.

The input/output interface 150 transfers instructions or data input from a user or another external device to the other element(s) of the electronic device 101. The input/output interface 150 outputs the instructions or data received from the other element(s) of the electronic device 101 to the user, a first external electronic device 102, a second external electronic device 104, or a server 106.

The display 160 includes a liquid crystal display (LCD), a light emitting diode (LED) display, an organic LED (OLED) display, a micro electro mechanical system (MEMS) display, an electronic paper display, displays various types of content such as a text, images, videos, icons, symbols, and webpages for the user, and includes a touch screen that receives a touch, gesture, proximity, or hovering input from an electronic pen or the user's body part.

The communication interface 170 establishes communication between the electronic device 101 and the first external electronic device 102, the second external electronic device 104, or the server 106. For example, the communication interface 170 can communicate with the first external electronic device 102 through a wireless communication or a wired communication 164, and communicate with the second external electronic device 104 or the server 106 in connection to a network 162 through wireless communication or wired communication. For example, the wireless communication may conform to a cellular communication protocol including at least one of LTE, LTE-advanced (LTE-A), CDMA, wideband CDMA (WCDMA), universal mobile telecommunications system (UMTS), wireless broadband (WiBro), and GSM.

The wired communication 164 includes at least one of universal serial bus (USB), high definition multimedia interface (HDMI), recommended standard 232 (RS-232), and plain old telephone service (POTS).

The network 162 includes a telecommunications network, a computer network such as a local area network (LAN) or a wide area network (WAN), the Internet, and a telephone network, for example.

The electronic device 101 provides the LTE service in the single radio environment by use of at least one module functionally or physically separated from the processor 120.

Embodiments of the present disclosure will be described with reference to a display that includes a bent or curved area and is applied to a housing of an electronic device 101, in which a non-metal member and a metal member (e.g., a metal bezel) are formed through dual injection molding, but the present disclosure is not limited thereto. For example, the display 160 may be applied to a housing, in which a metal member or a non-metal member is formed of a single material.

Each of the first external electronic device 102 and the second external electronic device 104 may be a same or a different type of device as the electronic device 101.

The server 106 includes a group of one or more servers.

All or some of the operations to be executed by the electronic device 101 may be executed by the first external electronic device 102, the second external electronic device 104, and/or the server 106. For example, when the electronic device 101 should perform a certain function, the electronic device 101 may request some functions that are associated therewith from the first external electronic device 102, the second external electronic device 104, and/or the server 106, instead of or in addition to executing the function or service by itself. The first external electronic device 102, the second external electronic device 104, or the server 106 may execute the requested functions or additional functions, and transmit the results to the electronic device 101. The electronic device 101 provides the requested functions or services by processing the received results as they are or after additionally. For example, a cloud computing technique, a distributed computing technique, or a client-server computing technique may be used.

Figure 2A:
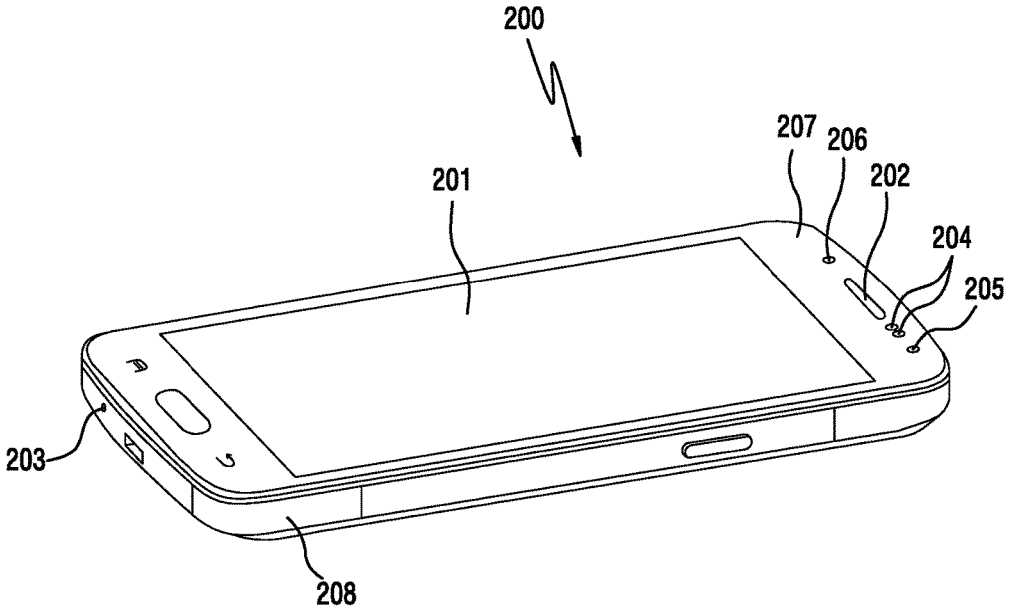
FIG. 2A illustrates a front side of the electronic device according to embodiments of the present disclosure.

FIG. 2A illustrates a front side of the electronic device 200 according to embodiments of the present disclosure.

In FIG. 2A, the electronic device 200 includes a display 201 installed on the front surface 207 thereof. A speaker device 202 may be installed above the display 201 so as to receive a voice of a counterpart. A microphone device 203 may be installed below the display 201 so as to transmit a voice of the user of the electronic device. According to one embodiment, one or more components for conducting various functions of the electronic device 200 may be arranged around the speaker device 202. The components include at least one sensor module 204, a camera device 205, and an LED indicator 206 that informs the user of the status information of the electronic device 200. The sensor module 204 includes at least one of, for example, an illuminance sensor (e.g., an optical sensor), a proximity sensor, an infrared sensor, and an ultrasonic sensor.

According to embodiments, the electronic device includes a side surface 208 having a predetermined height from the front surface. The side surface 208 may be implemented to form a visually pleasing appearance through a vapor deposition process.

Figure 2B:
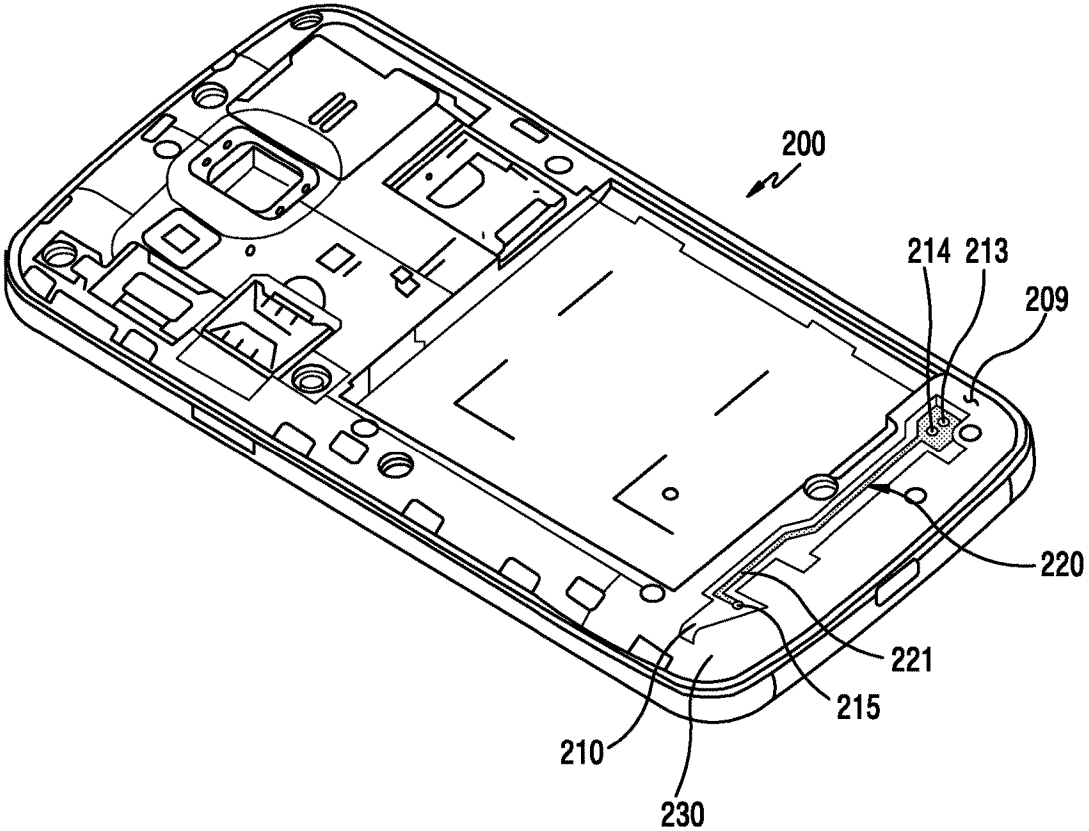
FIG. 2B illustrates a rear side of the electronic device according to embodiments of the present disclosure when a cover member is removed.

FIG. 2B illustrates a rear side of the electronic device 200 according to embodiments of the present disclosure when a cover member is removed.

Referring to FIG. 2B, when the cover member is removed from the rear surface 209 of the electronic device 200, an antenna radiator 220 may be integrally formed with the housings 210 and 230. The antenna radiator 220 may be visually observed from the rear surface 209 of the electronic device 200. According to another embodiment, the antenna radiator 220 may not be visually observed when a painting process was performed. The antenna radiator 220 may be disposed on a first surface of a first non-conductive structure 210 in various manners.

According to embodiments, the cover member may be a battery cover that protects a battery pack, which is removably installed to the electronic device 200 and visually enhances the external appearance of the electronic device 200. The cover member may be integrated with the electronic device 200 to serve as a rear housing of the electronic device 200.

According to embodiments, the housing of the electronic device 200 includes a first non-conductive structure 210 including an antenna radiator 220, and a second non-conductive structure 230 that is injection molded to the first non-conductive structure 210. The second non-conductive structure 230 may be in-mold injection molded to the first non-conductive structure 210. In such a case, the antenna radiator 220 is not included in the region of the second non-conductive structure 230 that forms the side surface of the electronic device 200, due to the reason for subsequently performing a smooth deposition process on a rim of the electronic device. The antenna radiator 220 of the first non-conductive structure 210 according to embodiments does not overlap with a boundary portion of the second non-conductive structure 230, and is configured to extend to a third surface of the first non-conductive structure 210 through conductive connection parts 213, 214, and 215 formed on the first non-conductive structure 210 such that the antenna radiator can be prevented from being cracked and/or lost by external impact or an assembly tolerance between the first non-conductive structure 210 and the second non-conductive structure 220. The first non-conductive structure 210 may be formed through dual injection molding of different types of materials.

According to embodiments, the electronic device 200 of FIGS. 2A and 2B may be the electronic device 101 of FIG. 1. The electronic device includes a communication circuit that uses the antenna radiator 220 including a conductive pattern 221 and at least a part of the conductive connection parts as a radiation pattern.

Figure 3A:
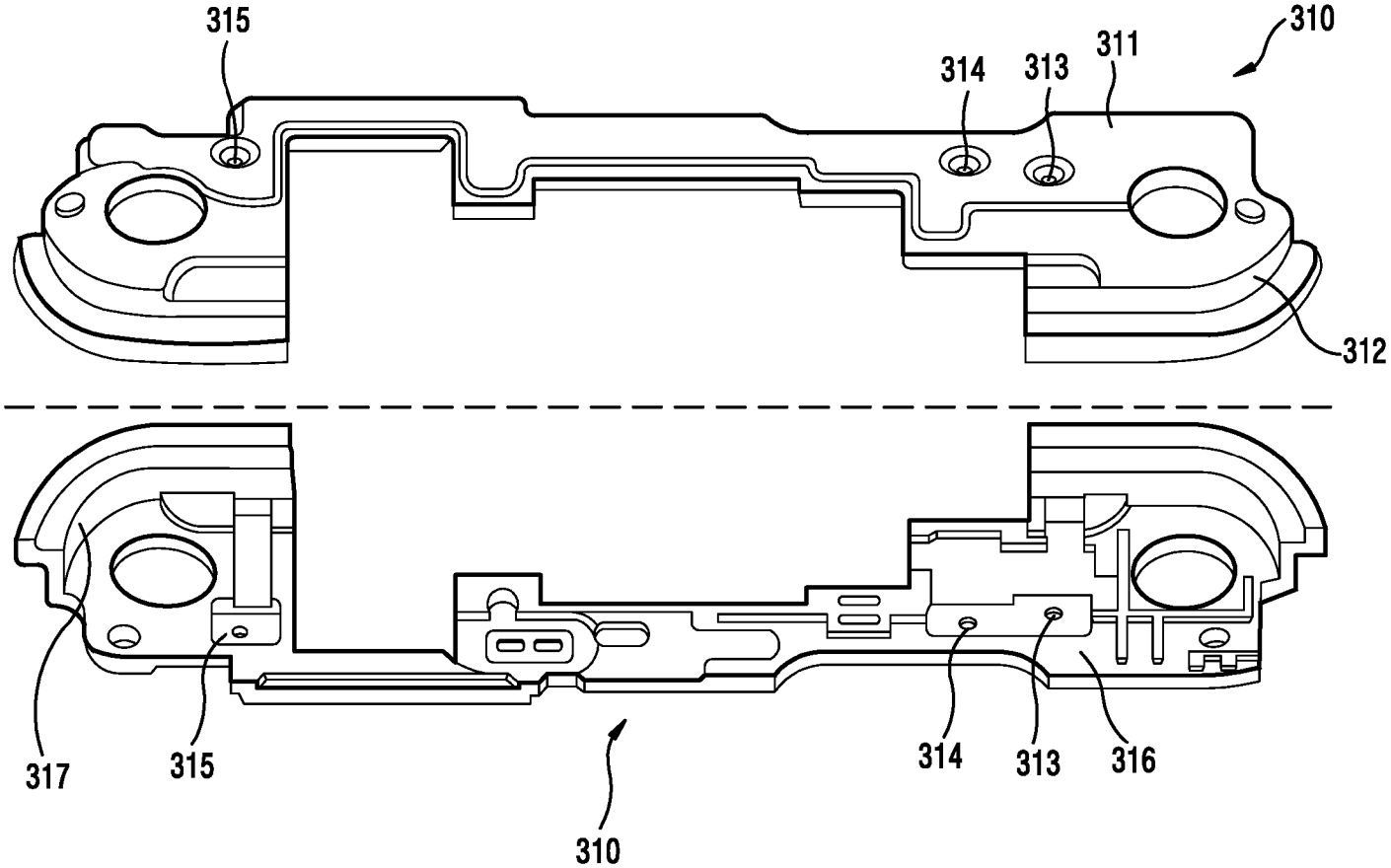
FIG. 3A illustrates a first non-conductive structure according to embodiments of the present disclosure.

FIG. 3A illustrates a first non-conductive structure 310 according to embodiments of the present disclosure. The first non-conductive structure 310 according to embodiments of the present disclosure may be an embodiment of the first non-conductive structure that is similar to or different from the first non-conductive structure 210 of FIG. 2B.

Referring to FIG. 3A, The first non-conductive structure 310 may be a dielectric body that is made of a synthetic resin material. A well-known dielectric material, which is capable of accommodating the antenna radiator, may be used. The first non-conductive structure 310 includes a first surface 311 and a second surface 312 formed in at least a partial region along the rim of the first surface 311 and having a height. One or more conductive connection parts 313, 314 and 315 may be formed on the first surface 311 of the first non-conductive structure 310.

The conductive connection parts 313, 314, and 315 may enable an antenna radiator 320 formed on the first surface 311 of the first non-conductive structure 310 to extend to a second surface 316 without being interfered with the second non-conductive structure 330. The first non-conductive structure 310 includes a third surface 317 that is opposite to the above-mentioned side surface 312. The third surface 317 may be formed to extend from the second surface 316.

According to embodiments, the antenna radiator may extend to the second surface of the first non-conductive structure through an open region of the second non-conductive structure where the first non-conductive structure is exposed, in addition to the conductive connection parts. The antenna radiator, which is formed on the first surface of the first non-conductive structure through a rivet type connection pin, may extend to the second surface of the first non-conductive structure without overlapping with the boundary of the second non-conductive structure.

Figure 3B:
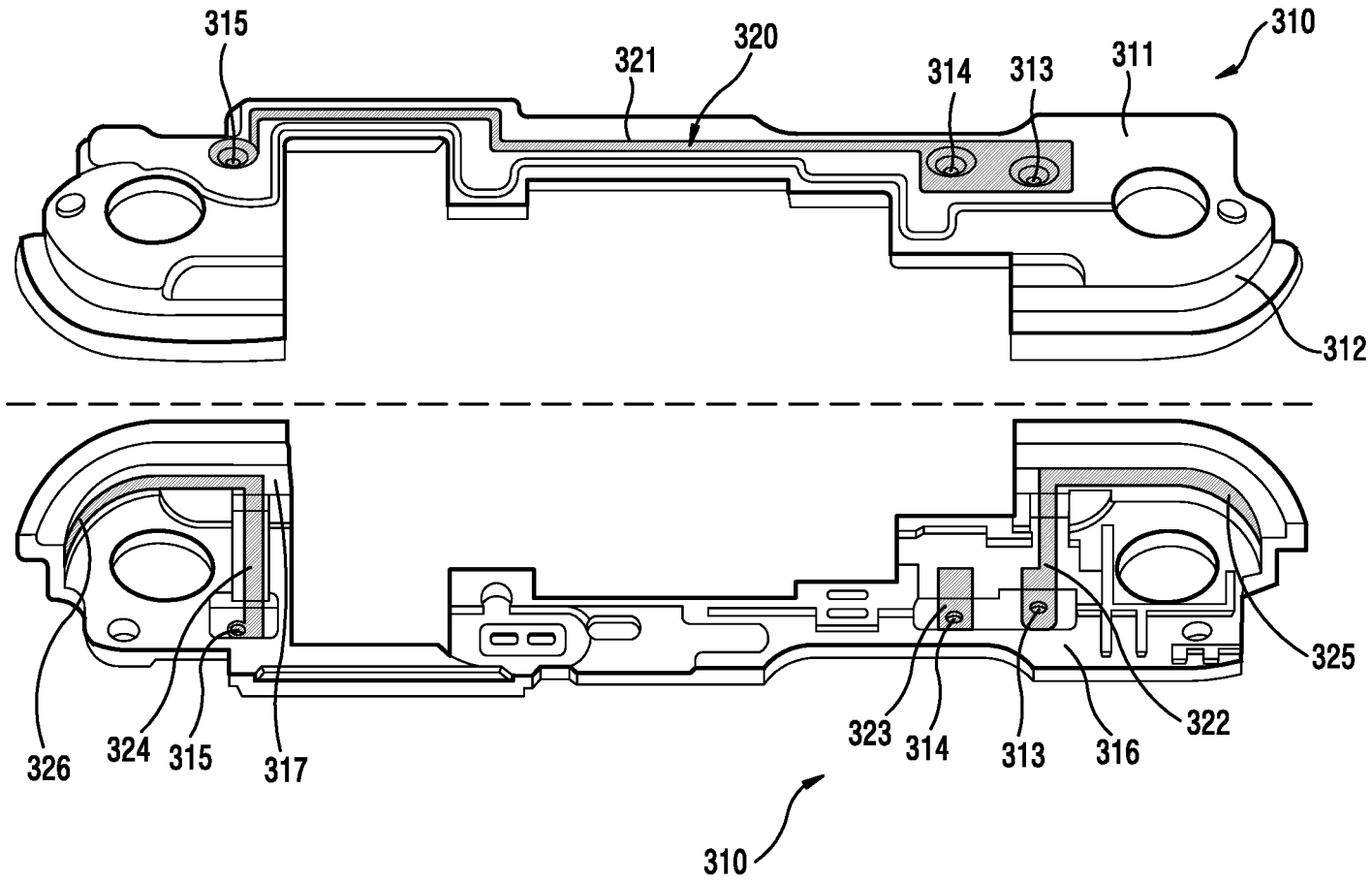
FIG. 3B illustrates when an antenna radiator is formed on the first non-conductive structure according to embodiments of the present disclosure.

FIG. 3B illustrates when the antenna radiator 320 is formed on the first non-conductive structure 310 according to embodiments of the present disclosure. Embodiments of the present disclosure, the first non-conductive structure 310 of FIG. 3B may be an embodiment of a non-conductive structure that is similar to or different from the first non-conductive structure 210 of FIG. 2B.

Referring to FIG. 3B, the antenna radiator 320 having a predetermined shape may be included in the first surface of the first non-conductive structure 310. The antenna radiator 320 may be formed on the first non-conductive structure 310 through the LDS method or through the IMA method. When space is sufficient, the antenna radiator 320 may be inserted into the first surface 311 of the first non-conductive structure 310 through an insert molding method in which a thin metal plate is exposed or non-exposed. The antenna radiator 320 may be formed through a method of attaching a metal tape to the first surface 311 of the first non-conductive structure 310. The antenna radiator 320 may be formed through a method of spray-coating a conductive material on the first surface 311 of the first non-conductive structure 310.

According to embodiments, the antenna radiator 320 may be formed to extend from the first surface 311 to the second surface 316 of the first non-conductive structure 310 through one or more conductive connection parts 313, 314, and 315. In such a case, the antenna radiator 320 may be electrically connected to the conductive patterns 322, 323, 324, 325, and 326 of the second surface 316 and the third surface 317 through each of the conductive connection parts 313, 314, and 317.

According to embodiments, the antenna radiator 320 includes a first conductive pattern 321 disposed on the first surface 311 of the first non-conductive structure 310. The antenna radiator 320 includes second conductive patterns 322, 323, and 324 that are disposed up to the second surface 316 of the first non-conductive structure 310 through the first, second, and third conductive connection parts 313, 314, and 315 of the first conductive pattern 321. The antenna radiator 320 includes third conductive patterns 325 and 326 that extend from the second conductive patterns 322, 323, and 324 to be disposed on the third surface 317. Any one 322 of the second conductive patterns 322, 323, and 324 may extend to any one 325 of the third conductive patterns 325 and 326 disposed on the third surface 317. Any one 324 of the second conductive patterns 324, 323, and 324 may extend to the remaining one 326 of the third conductive patterns 325 and 326 disposed on the third surface 317. All the first, second, and third conductive patterns 321, 322, 323, 324, 325, and 326 may maintain the mutually electrically connected state such that the radiating volume of the antenna radiator 320 can be increased and the antenna radiator 320 can operate in various bands of frequencies by having various shapes.

Figure 3C:
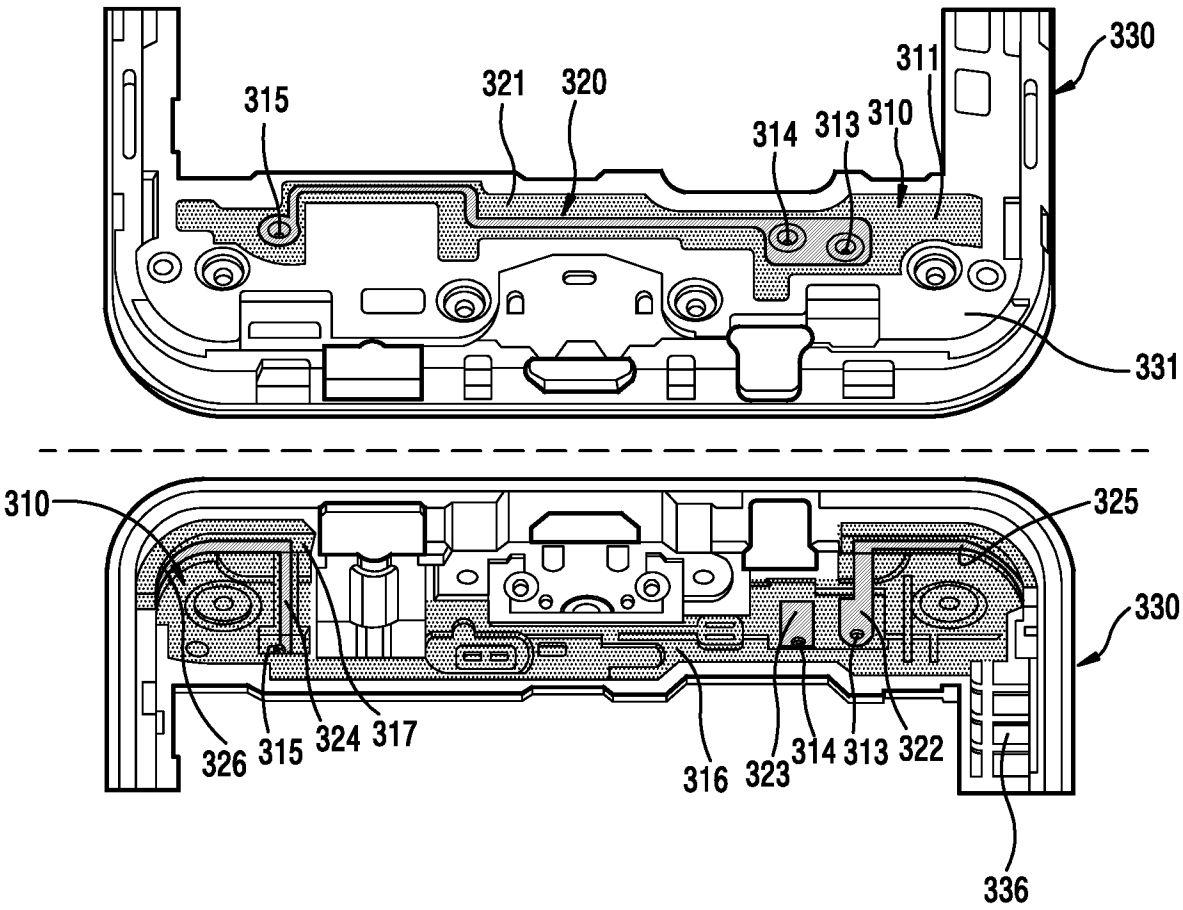
FIG. 3C illustrates when a second non-conductive structure is injection molded on the first non-conductive structure, which includes an antenna radiator, according to embodiments of the present disclosure.

FIG. 3C illustrates when a second non-conductive structure 330 is injection molded on the first non-conductive structure 310, which includes an antenna radiator 320, according to embodiments of the present disclosure. The first non-conductive structure 310 according to embodiments of the present disclosure may be an embodiment of a non-conductive structure that is similar to or different from the first non-conductive structure 210 of FIG. 2B. The second non-conductive structure 330 according to embodiments of the present disclosure may be an embodiment of a non-conductive structure that is similar to or different from the second non-conductive structure 230 of FIG. 2B.

Referring to FIG. 3C, a housing may be configured by performing in-mold injection molding of the second non-conductive structure 330 on the first non-conductive structure 310 that is formed with the antenna radiator 320. In such a case, the first conductive pattern 321 of the antenna radiator 320 formed on the first surface 311 of the first non-conductive structure 310 may be disposed not to overlap with the boundary between the first non-conductive structure 310 and the second non-conductive structure 330. For example, the first conductive pattern 321 formed on the first surface 311 of the first non-conductive structure 310 may directly extend to the second surface 316 of the first non-conductive structure 310 through the conductive connection parts 313, 314, and 315 disposed on the first surface of the first non-conductive structure.

The conductive connection parts 313, 314, and 315 may electrically interconnect the first conductive pattern 321 of the antenna radiator 320 disposed on the first surface of the first non-conductive structure 310 and the second conductive patterns 322, 323, and 324 disposed on the second surface 316 of the first non-conductive structure 310. Any one 322 of the second conductive patterns 322, 323, and 324 may extend to any one 325 of the third conductive patterns 325 and 326 disposed on the third surface 317 to be electrically connected thereto. Any one 324 of the second conductive patterns 324, 323, and 324 may extend to the remaining one 326 of the third conductive patterns 325 and 326 disposed on the third surface 317 to be electrically connected thereto.

According to embodiments, when the first conductive pattern 321 disposed on the first surface 311 of the first non-conductive structure 310 is electrically connected to the second conductive patterns 322, 323, and 324 disposed on the second surface 316 of the first non-conductive structure 310 and the third conductive patterns 325 and 326 disposed on the third surface 317 of the first non-conductive structure 310 through the conductive connection parts 313, 314, and 315, the patterns 321, 322, 323, 324, 325, and 326 of the antenna radiator 320 may be disposed not to overlap with the boundary between the first non-conductive structure 310 and the second non-conductive structure 330.

The second non-conductive structure 330 may be formed on the first non-conductive structure 310 through an insert molding method.

A separate coating member may be further provided in order to protect the first, second, and third conductive patterns 321, 322, 323, 324, 325, and 326 disposed on the first surface 311, the second surface 316, and the third surface 317 of the first non-conductive structure 310.

The first surface 311 of the first non-conductive structure 310 and the top surface 331 of the second non-conductive structure 330 may be formed to be flush with each other. The first surface 311 of the first non-conductive structure 310 may be formed to be higher or lower than the top surface 331 of the second non-conductive structure 330. Likewise, the second surface 316 of the first non-conductive structure 310 and the inner surface 336 of the second non-conductive structure 330 may be formed to be or not to be flush with each other.

Figure 4A:
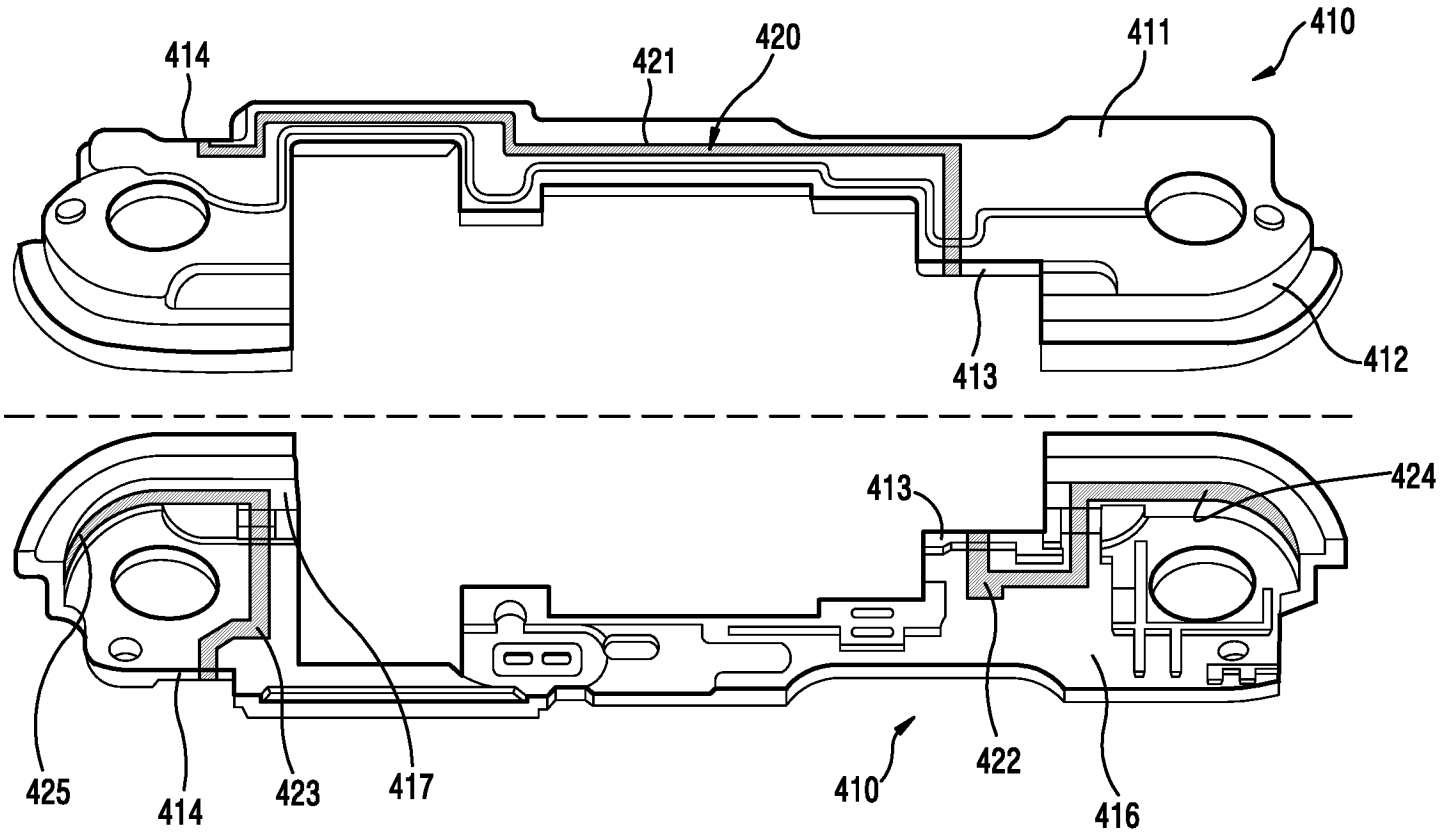
FIG. 4A illustrates when an antenna radiator is formed on the first non-conductive structure according to embodiments of the present disclosure.

FIG. 4A illustrates when an antenna radiator is formed on the first non-conductive structure according to embodiments of the present disclosure.

Referring to FIG. 4A, The first non-conductive structure 410 includes a first surface 411 and a side surface 412 formed in at least a partial region along the rim of the first surface 411 and having a height. The antenna radiator 420 may be included in the first surface 411 of the first non-conductive structure 410. The antenna radiator 420 may be formed in the same method as the method described above with reference to FIG. 3B. According to embodiments of the present disclosure, the first non-conductive structure 410 of FIG. 4A may be an embodiment of a non-conductive structure that is similar to or different from the first non-conductive structure 210 of FIG. 2B.

According to embodiments, the antenna radiator 420 may be formed to extend from the first surface 411 to the second surface 416 of the first non-conductive structure 410. In such a case, even if the first non-conductive structure 410 and the second non-conductive structure 430 were in-mold injection molded, the antenna radiator 420 may extend to the second surface 416 of the first non-conductive structure 410 through at least a portion of the exposure regions 413 and 414 of the first injection molded product 410 which are exposed without being interfered with the second non-conductive structure 430.

According to embodiments, the antenna radiator 420 includes a first conductive pattern 421 disposed on the first surface 411 of the first non-conductive structure 410. The antenna radiator 420 includes second conductive patterns 422 and 423 that extend up to the second surface 416 of the first non-conductive structure 410 by bypassing the first exposure region 413 and the second exposure region 414 that are disposed on the first surface 411 of the first non-conductive structure 410. The antenna radiator 420 includes third conductive patterns 424 and 425 that extend from the second conductive patterns 422 and 423 to be disposed on the third surface 417. Any one 422 of the second conductive patterns 422 and 423 may extend to any one 424 of the third conductive patterns 424 and 425 disposed on the third surface 417. The remaining one 423 of the second conductive patterns 422 and 423 may extend to the remaining one 425 of the third conductive patterns 424 and 425 disposed on the third surface 317. According to one embodiment, all the first, second, and third patterns 421, 422, 423, 424, and 425 maintain the mutually electrically connected state such that the radiating volume of the antenna radiator 420 can be increased and the antenna radiator 420 can operate in various bands of frequencies by having various shapes.

Figure 4B:
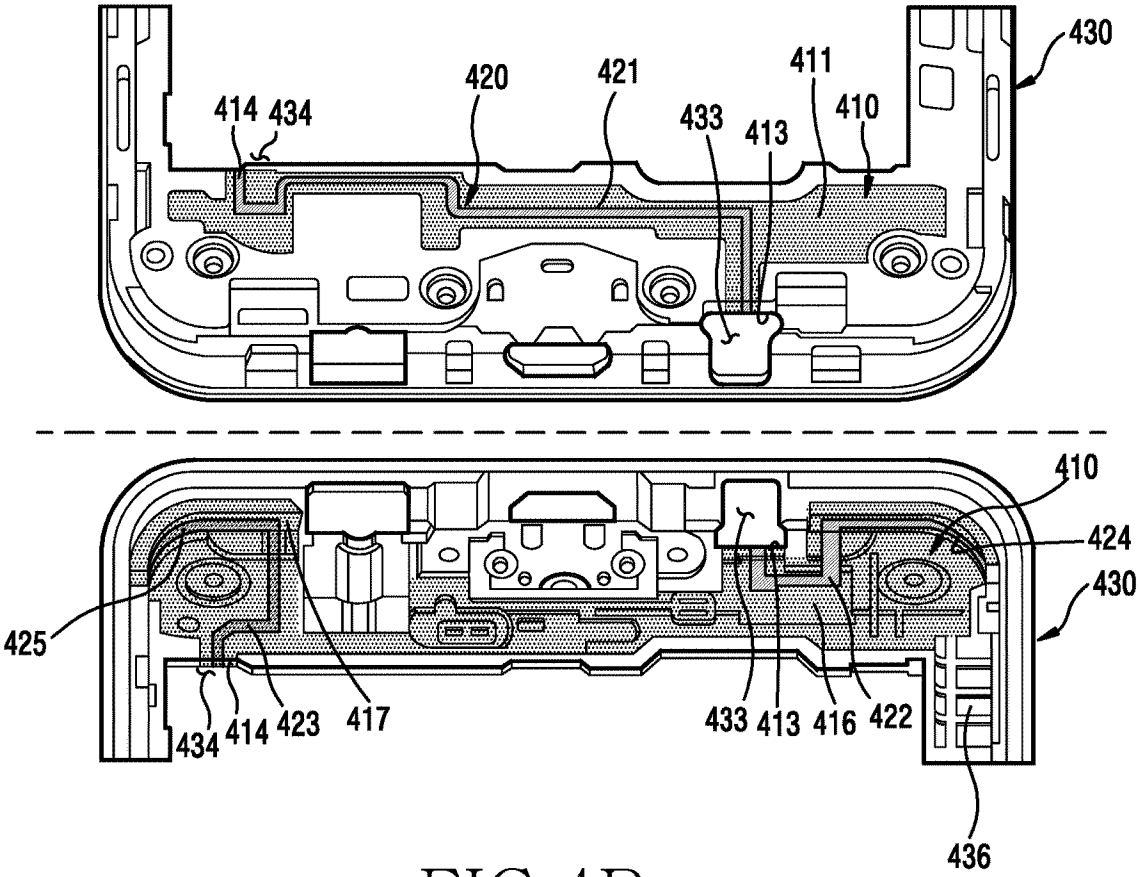
FIG. 4B illustrates when a second non-conductive structure is injection molded on the first non-conductive structure, which includes an antenna radiator, according to embodiments of the present disclosure.

FIG. 4B illustrates when a second non-conductive structure 430 is injection molded on the first non-conductive structure 410, which includes an antenna radiator 420, according to embodiments of the present disclosure. The first non-conductive structure 410 of FIG. 4B may be an embodiment of a non-conductive structure that is similar to or different from the first non-conductive structure 210 of FIG. 2B. The second non-conductive structure 430 of FIG. 4B may be an embodiment of a non-conductive structure that is similar to or different from the second non-conductive structure 230 of FIG. 2B.

Referring to FIG. 4B, a housing may be configured by performing in-mold injection molding of the second non-conductive structure 430 on the first non-conductive structure 410 that is formed with the antenna radiator 420. In such a case, the first conductive pattern 421 of the antenna radiator 420 formed on the first surface 411 of the first non-conductive structure 410 may be disposed not to overlap with the boundary between the first non-conductive structure and the second non-conductive structure. For example, the first conductive pattern 421 formed on the first surface 411 of the first non-conductive structure 410 may directly extend to the second surface 416 of the first non-conductive structure 410 through the region where the first non-conductive structure 410 is exposed even if two injection molded products 410 and 430 are in-mold injection molded without bypassing the boundary region of the second non-conductive structure 430 or the side surface of the second non-conductive structure 430.

According to embodiments, one end of the first conductive pattern 421 may extend through the first exposure region 413 of the first non-conductive structure 410. The extended first conductive pattern 421 may extend to the second surface 416 of the first non-conductive structure 410 through an opening 433 of the second non-conductive structure 430 so as to configure a second conductive pattern 422. The first conductive pattern 421 may extend to the second surface 416 of the first non-conductive structure 410 through the opening portion 434 of the second non-conductive structure 430 so as to configure a second conductive pattern 423.

The second antenna radiator 430 may be formed on the first non-conductive structure 410 through an insert molding method.

A separate coating member may be further provided in order to protect the first, second, and third conductive patterns 421, 422, 423, 424, and 425 disposed on the first surface 411, the second surface 416, and the third surface 417 of the first non-conductive structure 410.

The first surface 411 of the first non-conductive structure 410 and the top surface 431 of the second non-conductive structure 430 may be formed to be flush with each other. The first surface 411 of the first non-conductive structure 410 may be may be formed to be higher or lower than the top surface 431 of the second non-conductive structure 430. Likewise, the second surface 416 of the first non-conductive structure 410 and the inner surface 436 of the second non-conductive structure 430 may be formed to be or not to be flush with each other.

Figure 5A:
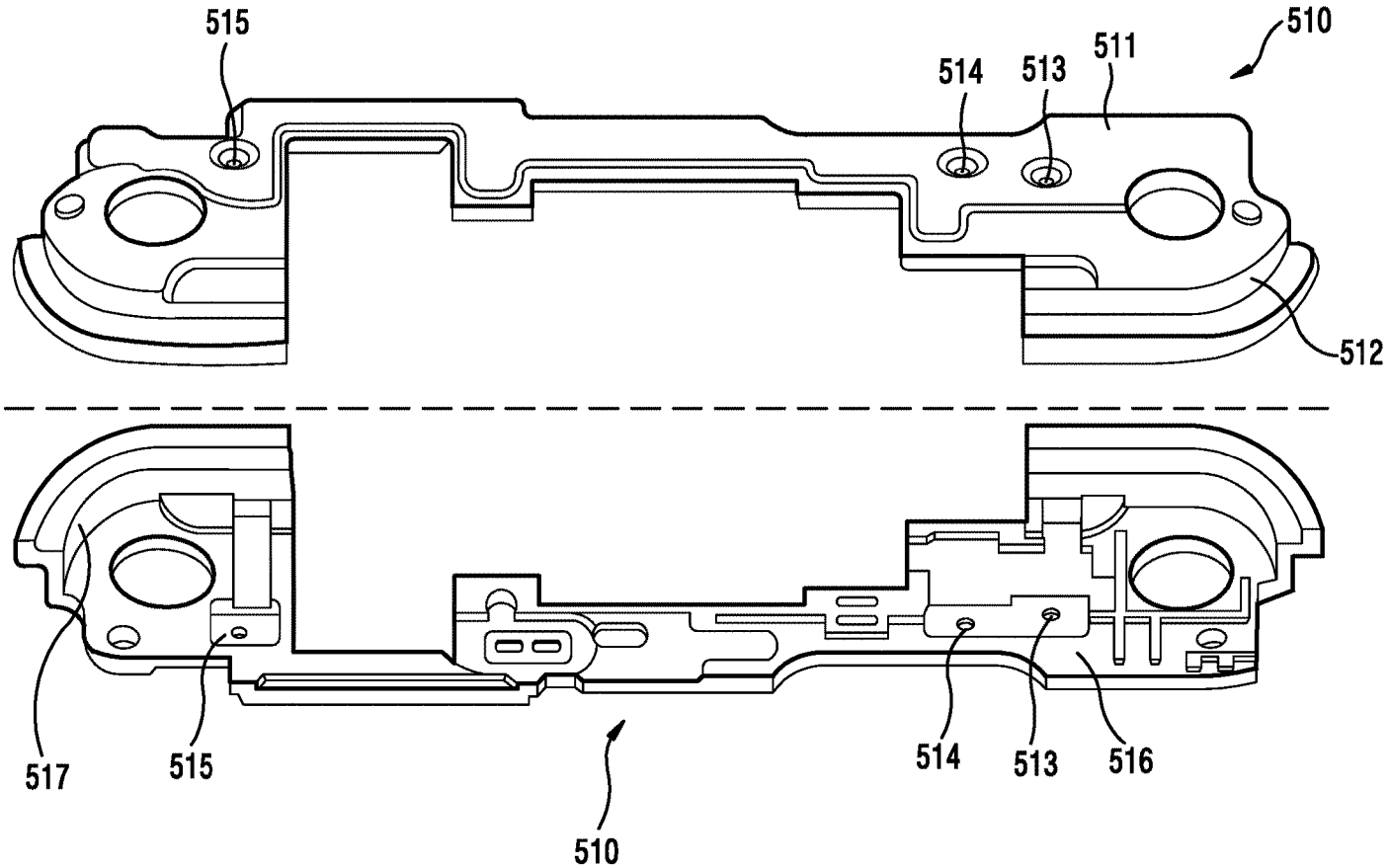
FIG. 5A illustrates a first non-conductive structure according to embodiments of the present disclosure.

FIG. 5A illustrates a first non-conductive structure 510 according to embodiments of the present disclosure. The first non-conductive structure 510 may be an embodiment of the first non-conductive structure that is similar to or different from the first non-conductive structure 210 of FIG. 2B.

Referring to FIG. 5A, The first non-conductive structure 510 may be a dielectric body that is made of a synthetic resin material. A well-known dielectric material, which is capable of accommodating the antenna radiator, may be used. The first non-conductive structure 510 includes a first surface 511 and a second surface 512 formed in at least a partial region along the rim of the first surface 511 and having a height. One or more conductive connection parts 513, 514 and 515 may be formed on the first surface 511 of the first non-conductive structure 510. The conductive connection parts 513, 514, and 515 may enable an antenna radiator 520 formed on the first surface 511 of the first non-conductive structure 510 to extend to a second surface 516 without being interfered with the second non-conductive structure 530. The first non-conductive structure 510 includes a third surface 517 that is opposite to the above-mentioned side surface 512. The third surface 517 may be formed to extend from the second surface 516.

According to embodiments, the antenna radiator may extend to the second surface of the first non-conductive structure through an open region of the second non-conductive structure where the first non-conductive structure is exposed, in addition to the conductive connection parts. The antenna radiator, which is formed on the first surface of the first non-conductive structure through a rivet type connection pin, may extend to the second surface of the first non-conductive structure without overlapping with the boundary of the second non-conductive structure.

Figure 5B:
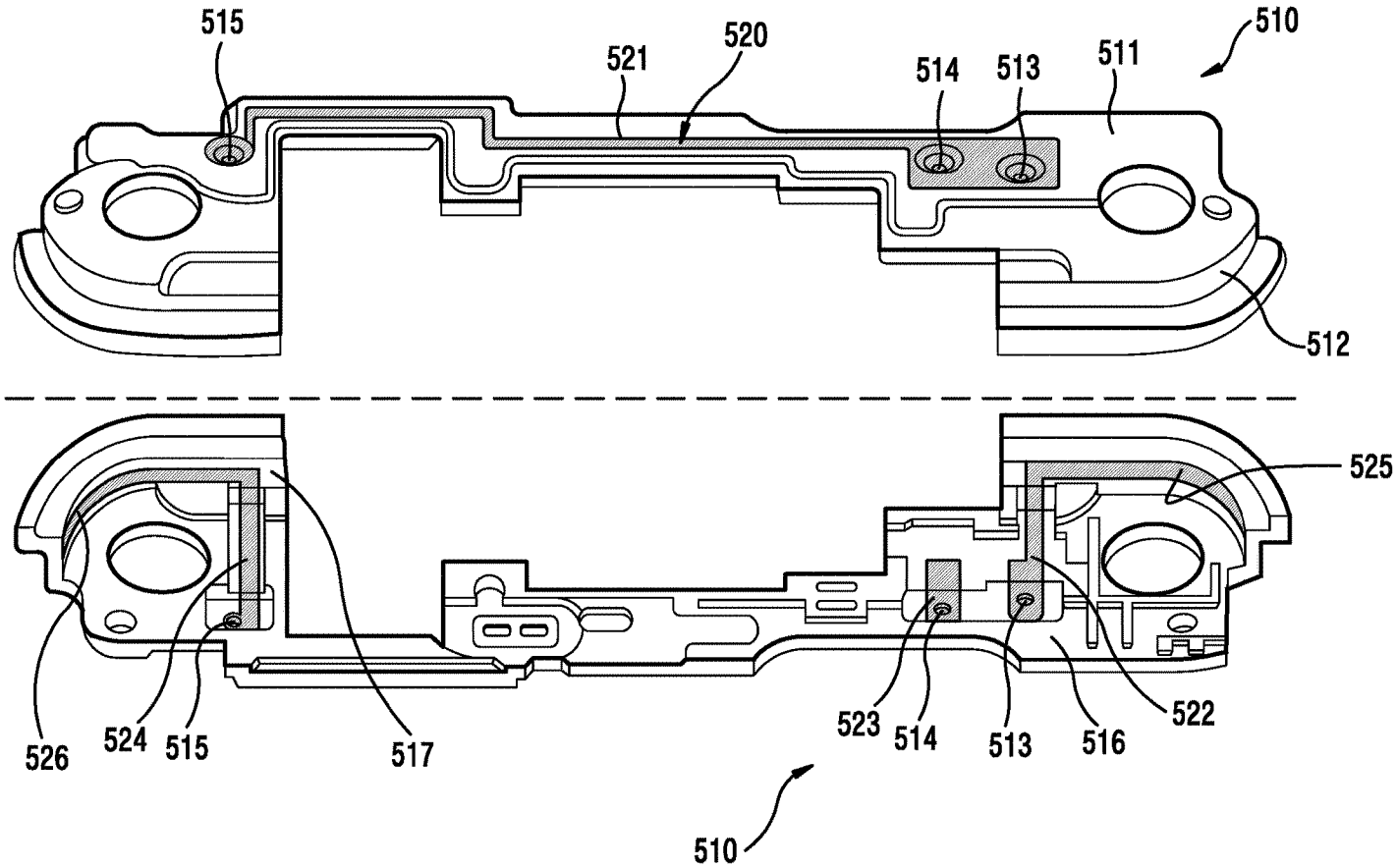
FIG. 5B illustrates when an antenna radiator is formed on the first non-conductive structure according to embodiments of the present disclosure.

FIG. 5B illustrates when the antenna radiator 520 is formed on the first non-conductive structure 510 according to embodiments of the present disclosure. The first non-conductive structure 510 of FIG. 5B may be an embodiment of a non-conductive structure that is similar to or different from the first non-conductive structure 210 of FIG. 2B.

Referring to FIG. 5B, the antenna radiator 520 having a predetermined shape may be included in the first surface of the first non-conductive structure 510. The antenna radiator 520 may be formed on the first non-conductive structure 510 through the LDS method or the IMA method. When a space is permissible, the antenna radiator 520 may be inserted into the first surface 511 of the first non-conductive structure 510 through an insert molding method in which a thin metal plate is exposed or non-exposed. The antenna radiator 520 may be formed through a method of attaching a metal tape to the first surface 511 of the first non-conductive structure 510. The antenna radiator 520 may be formed through a method of spray-coating a conductive material on the first surface 511 of the first non-conductive structure 510.

According to embodiments, the antenna radiator 520 may be formed to extend from the first surface 511 to the second surface 516 of the first non-conductive structure 510 through one or more conductive connection parts 513, 514, and 515. In such a case, the antenna radiator 520 may be electrically connected to the conductive patterns 522, 523, 524, 525, and 526 of the second surface 516 and the third surface 517 through each of the conductive connection parts 513, 514, and 515.

According to embodiments, the antenna radiator 520 includes a first conductive pattern 521 disposed on the first surface 511 of the first non-conductive structure 510. The antenna radiator 520 includes second conductive patterns 522, 523, and 524 that are disposed up to the second surface 516 of the first non-conductive structure 510 through the first, second, and third conductive connection parts 513, 514, and 515 of the first conductive pattern 521. The antenna radiator 520 includes third conductive patterns 525 and 526 that extend from one or more 522 and 524 of the second conductive patterns 522, 523, and 524 to be disposed on the third surface 517. Any one 522 of the second conductive patterns 522, 523, and 524 may extend to any one 525 of the third conductive patterns 525 and 526 disposed on the third surface 517. Any one 524 of the second conductive patterns 522, 523, and 524 may extend to the remaining one 526 of the third conductive patterns 525 and 526 disposed on the third surface 517. All the first, second, and third conductive patterns 521, 522, 523, 524, 525, and 526 may maintain the mutually electrically connected state such that the radiating volume of the antenna radiator 520 can be increased and the antenna radiator 520 can operate in various bands of frequencies by having various shapes.

Figure 5C:
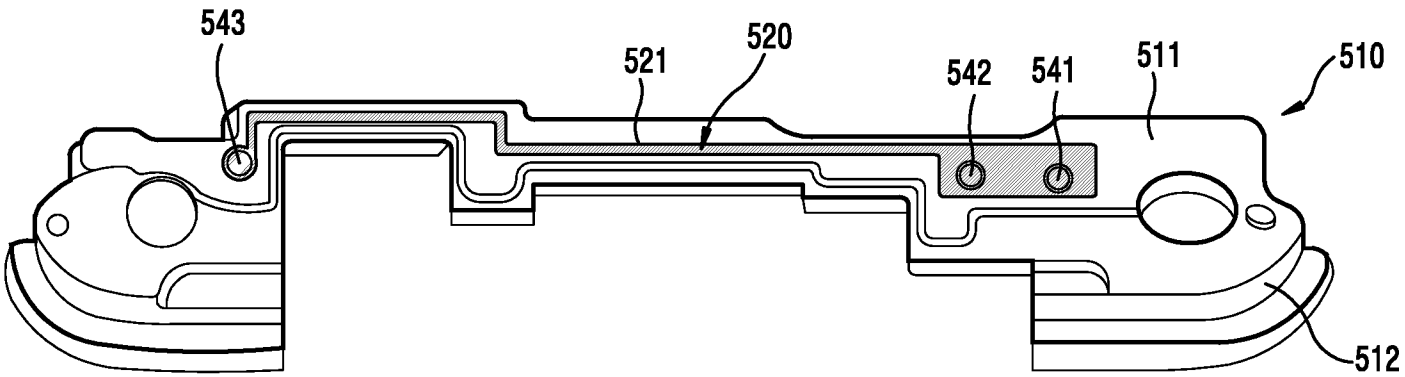
FIG. 5C illustrates when an antenna radiator is formed on the first non-conductive structure according to embodiments of the present disclosure.

FIG. 5C illustrates when the antenna radiator 520 is formed on the first non-conductive structure 510 according to embodiments of the present disclosure.

In FIG. 5C, first, second, and third press-fit pins 541, 542, and 543 made of a metallic material may be inserted into the first, second, and third conductive connection parts 513, 514, and 515, respectively, for the purpose of sound electrical connection between the first conductive pattern 521 and the second conductive patterns 522, 523, and 524.

Figure 5D:
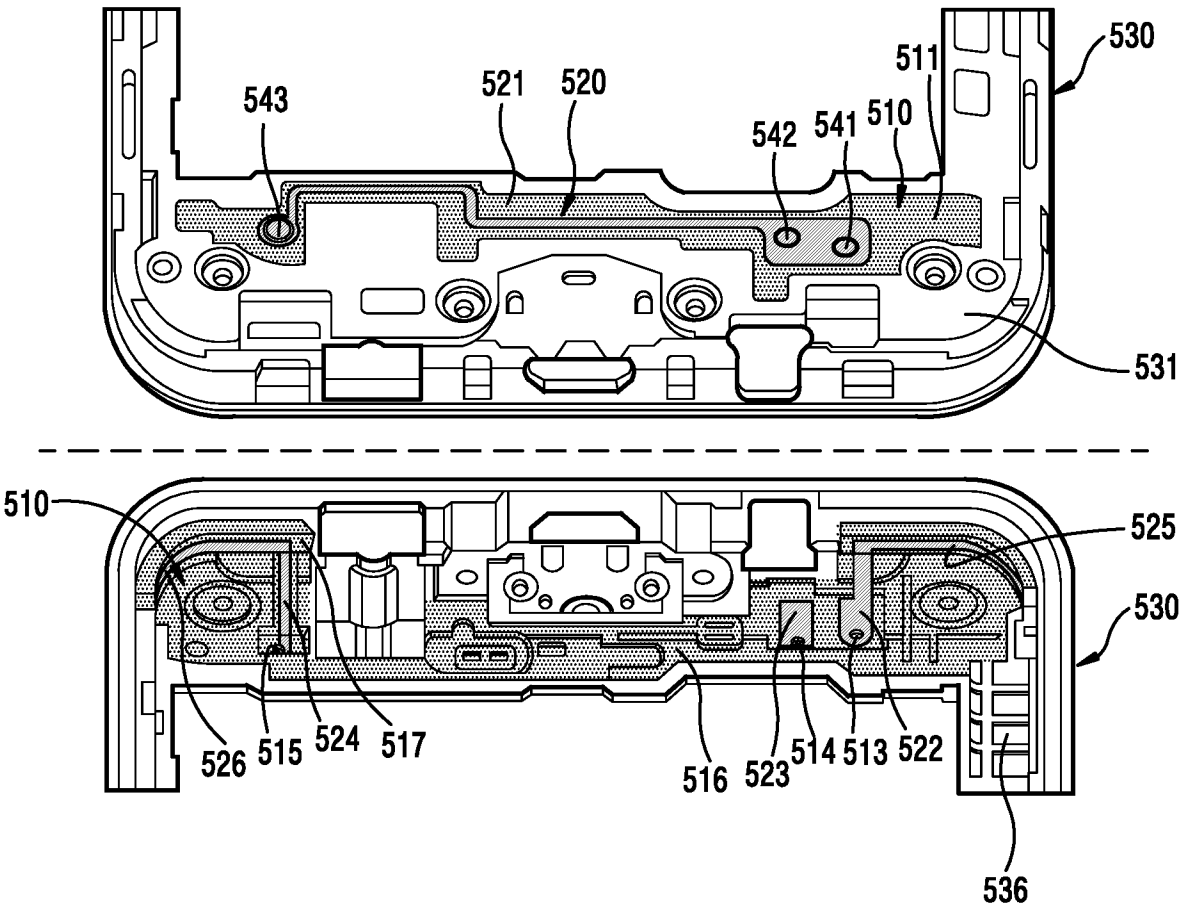
FIG. 5D illustrates when a second non-conductive structure is injection molded on the first non-conductive structure, which includes an antenna radiator, according to embodiments of the present disclosure.

Referring to FIG. 5D, a housing may be configured by performing in-mold injection molding of the second non-conductive structure 530 on the first non-conductive structure 510 that is formed with the antenna radiator 520. In such a case, the first conductive pattern 521 of the antenna radiator 520 formed on the first surface 511 of the first non-conductive structure 510 may be disposed not to overlap with the boundary between the first non-conductive structure 510 and the second non-conductive structure 530. For example, the first conductive pattern 521 formed on the first surface 511 of the first non-conductive structure 510 may directly extend to the second surface 516 of the first non-conductive structure 510 through the conductive connection parts 513, 514, and 515 disposed on the first surface 511 of the first non-conductive structure 510.

The conductive connection parts 513, 514, and 515 may electrically interconnect the first conductive pattern 521 of the antenna radiator 520 disposed on the first surface of the first non-conductive structure 510 and the second conductive patterns 522, 523, and 524 disposed on the second surface 516 of the first non-conductive structure 510. Any one 522 of the second conductive patterns 522, 523, and 524 may extend to any one 525 of the third conductive patterns 525 and 526 disposed on the third surface 517 to be electrically connected thereto. Any one 524 of the second conductive patterns 522, 523, and 524 may extend to the remaining one 526 of the third conductive patterns 526 and 326 disposed on the third surface 517 to be electrically connected thereto.

When the first conductive pattern 521 disposed on the first surface 511 of the first non-conductive structure 510 is electrically connected to the second conductive patterns 522, 523, and 524 disposed on the second surface 516 of the first non-conductive structure 510 and the third conductive patterns 525 and 526 disposed on the third surface 517 of the first non-conductive structure 510 through the conductive connection parts 513, 514, and 515, the patterns 521, 522, 523, 524, 525, and 526 of the antenna radiator 520 may be disposed not to overlap with the boundary between the first non-conductive structure 510 and the second non-conductive structure 530. According to embodiments, the smooth electric connection between the first conductive pattern 521 and the second conductive patterns 522, 523, and 524 can be achieved by inserting the press-fit pins 541, 542, and 543 into the conductive connection parts 513, 514, and 515, respectively.

The second non-conductive structure 530 may be formed on the first non-conductive structure 510 through an insert molding method.

A separate coating member may be further provided in order to protect the first, second, and third conductive patterns 521, 522, 523, 524, 525, and 526 disposed on the first surface 511, the second surface 516, and the third surface 517 of the first non-conductive structure 510.

The first surface 511 of the first non-conductive structure 510 and the top surface 531 of the second non-conductive structure 530 may be formed to be flush with each other. The first surface 511 of the first non-conductive structure 510 may be formed to be higher or lower than the top surface 531 of the second non-conductive structure 530. Likewise, the second surface 516 of the first non-conductive structure 510 and the inner surface 536 of the second non-conductive structure 530 may be formed to be or not to be flush with each other.

Figure 6A:
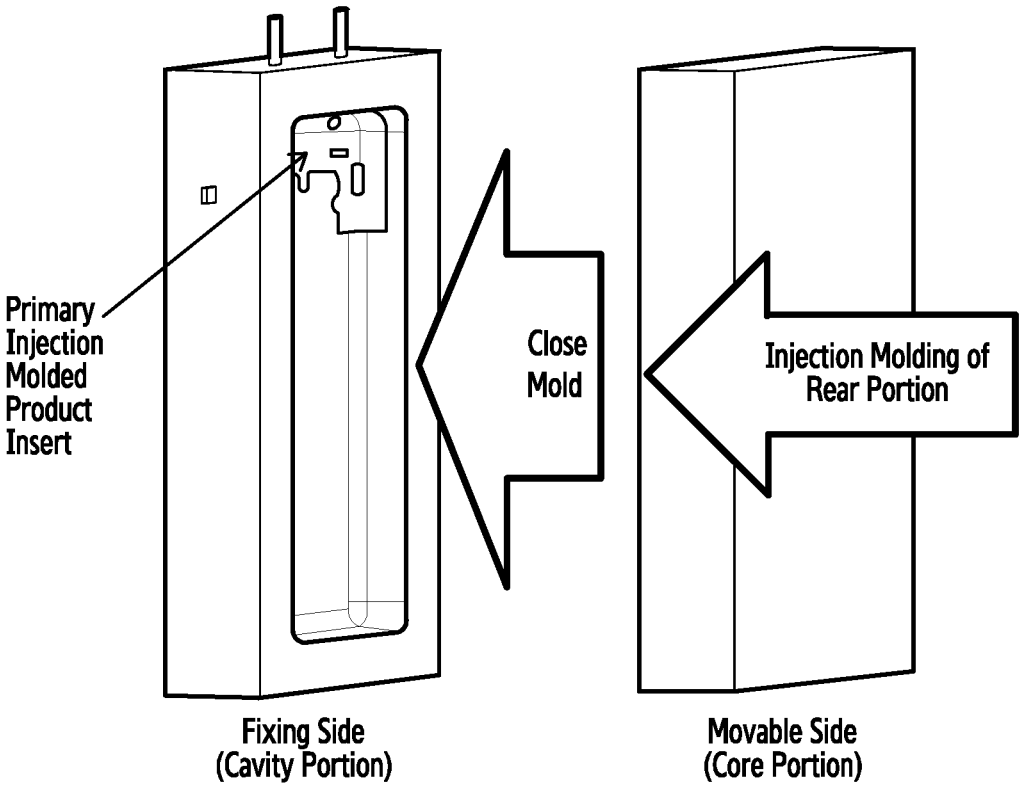
FIG. 6A illustrates an injection molding mold for manufacturing a housing according to embodiments of the present disclosure.

FIG. 6A illustrates an injection molding mold for manufacturing a housing according to embodiments of the present disclosure.

Referring to FIG. 6A, a case-integrated antenna structure may be manufactured by placing a first non-conductive structure, such as an antenna carrier, manufactured according to one embodiment at a mold cavity side, and performing injection from a mold core side. For example, the manufactured case-integrated antenna structure is applicable to when an injection molding thickness is thin compared to a cap type (e.g., a type that includes an antenna radiator and includes an antenna in the form of an injection molded product that is provided separately from the housing), and may be a structure that is advantageous for securing a radiation function since the first non-conductive structure, such as the antenna carrier, is positioned at the outermost area of an electronic device.

According to embodiments of the present disclosure, a conductive pattern used as an antenna radiator is not applied to a portion that is configured with the second non-conductive structure, which makes a deposition process applicable. In the prior art, it was not possible to apply such a deposition process since a plating process was performed after all of injection molded products were formed. However, a deposition process applied to the exterior of an electronic device according to the present disclosure provides an enhanced appearance.

Figure 6B:
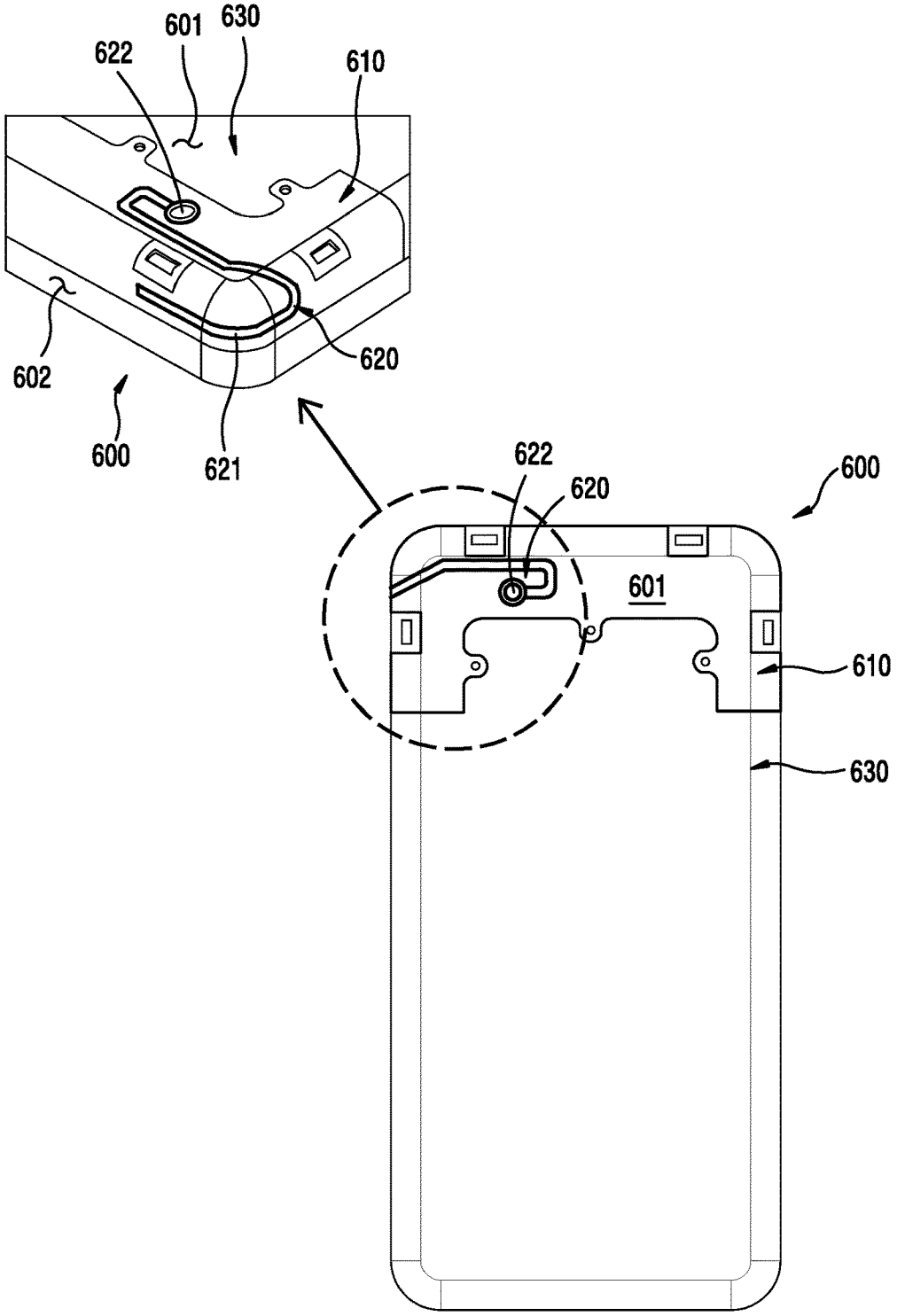
FIGS. 6B and 6C illustrate a housing when an antenna radiator according to embodiments of the present disclosure is applied to an outer region of an electronic device.
Figure 6C:
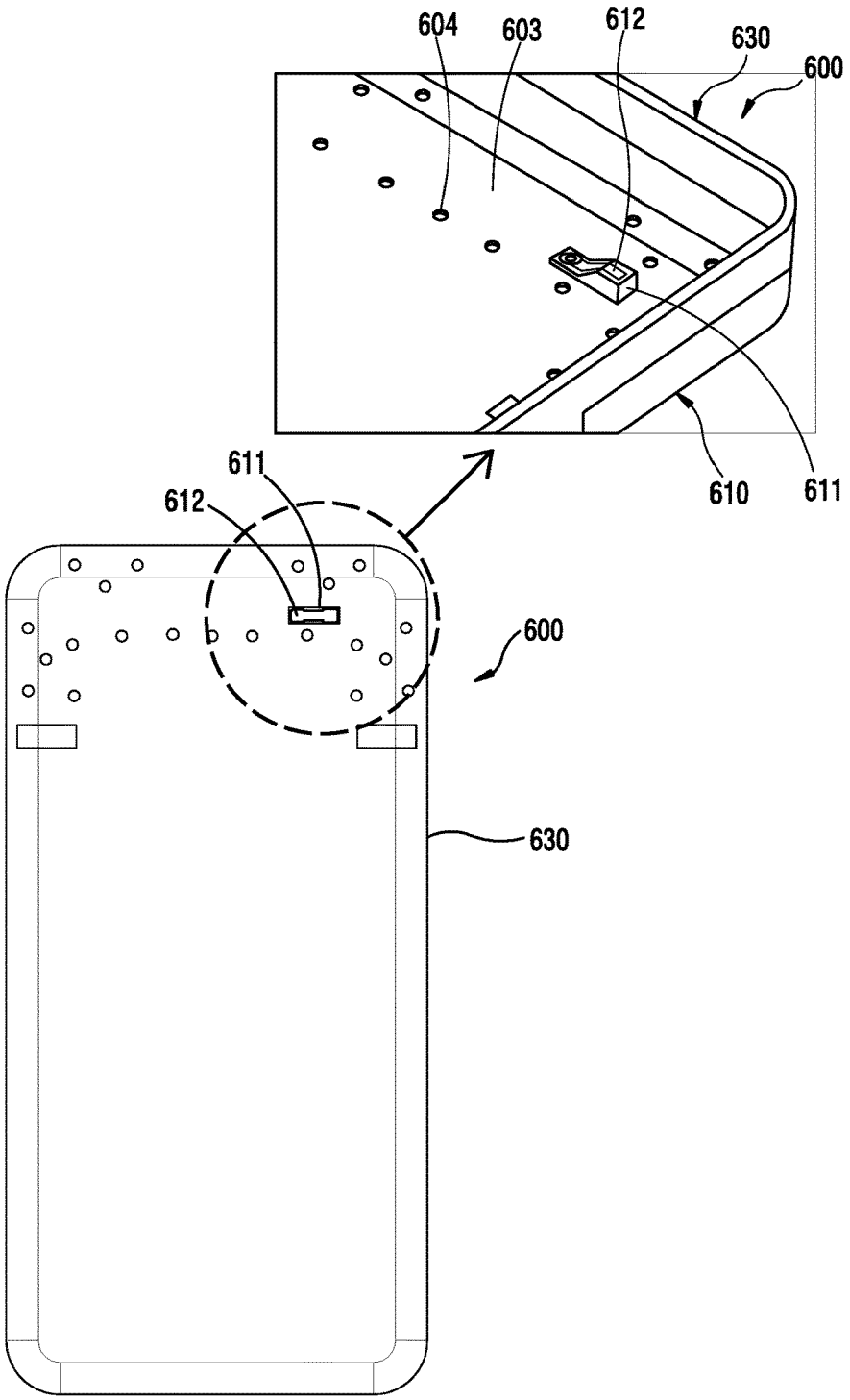

FIGS. 6B and 6C illustrate a housing 600 when an antenna radiator 620 according to embodiments of the present disclosure is applied to an outer region of an electronic device.

Referring to FIGS. 6B and 6C, the housing 600 includes a first non-conductive structure 610 and a second non-conductive structure 630 that may be formed through in-mold injection molding. The housing 600 includes a first non-conductive structure 610 including a first surface 601 that surfaces in a first direction and a second surface 603 that surfaces in a second direction, and a second non-conductive structure 630 formed integrally with a portion of the first non-conductive structure 610 and forming at least a portion of a third surface 602 that surfaces in a third direction that is different from the first direction and the second direction.

For example, the first non-conductive structure 610 may be formed from the first surface 601 from the housing 600 to a portion of the third surface 602 of the housing 600. The conductive pattern 621 of the antenna radiator 620 formed on the first non-conductive structure 610 may be formed to extend from the first surface 601 to the third surface 602 of the housing 600. In such a case, due to the conductive pattern 621 extending to the third surface 602 of the housing 600, a deposition process may not be performed on the corresponding region of the housing 600. A separate ornamental member (e.g., deco) may be disposed in a region of the side surface where the antenna radiator 620 is disposed. The deposition process may be performed on an outer region where no antenna pattern exists. The antenna pattern 621 may be formed to extend to the top surface of the housing 600.

According to one embodiment, a conductive connection body 611, such as a press-fit clip, at one end of the conductive pattern 621 is disposed on the first surface 601 of the housing 600. Various methods for an electric connection according to one embodiment may be used.

For example, the conductive connection body 611 may be exposed to the second surface 603 of the housing 600 to serve as an antenna contact portion 612 electrically connected to the antenna radiator 620 via a conductive connection part 622, as illustrated in FIG. 6B. In such a case, when a power feeding portion (RF contact) of a printed circuit board installed on the second surface 603 of the housing 600 according to one embodiment is coupled to the housing, the antenna radiator and the power feeding portion can be electrically connected to each other.

According to one embodiment, a plurality of protrusions 604 may be formed on the second surface 603 of the housing 600 so as to cause the first non-conductive structure 610 to closely contact the fixing side cavity of the mold. When protrusions are formed on the movable side (core section) of the mold, a plurality of stepped portions may be formed on the second surface 603 of the housing such that the protrusions are inserted into the stepped portions.

Figure 7:
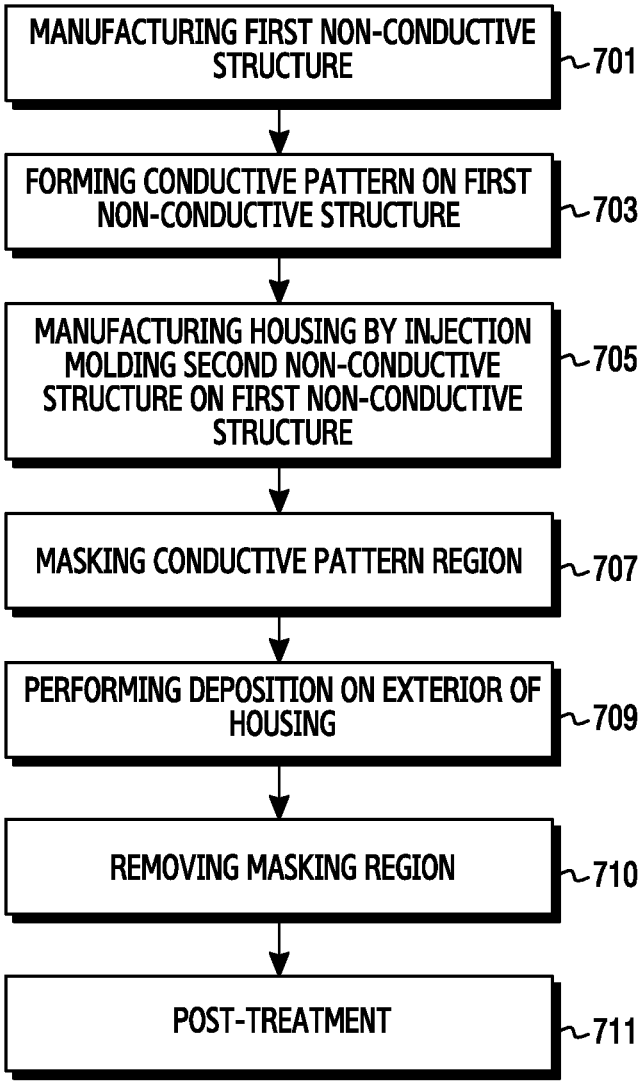
FIG. 7 illustrates a method of manufacturing a housing including an antenna according to embodiments of the present disclosure.

FIG. 7 illustrates a method of manufacturing a housing including an antenna according to embodiments of the present disclosure. The method of FIG. 7 will be described in reference to FIGS. 3A to 6B.

Referring to FIG. 7, a first non-conductive structure 310 is manufactured in step 701. The first non-conductive structure 310 includes a first surface surface 311 and a side surface surface 312, and the first surface may be formed to have an area on which the antenna radiator 320 can be disposed.

In step 703, an antenna pattern is formed on the first non-conductive structure. Specifically, the antenna radiator 320 may be formed on the first non-conductive structure 310. The antenna radiator may be disposed to extend from the first surface 311 of the first non-conductive structure surface 310 to the second surface 316 of the first non-conductive structure surface 310 through at least one conductive connection part 313, 314, or 315.

The antenna radiator 420 may be disposed to extend to the second surface 416 of the first non-conductive structure 410 along at least a portion of the exposed region through at least a portion of exposure regions 413 and 414 in which the interference of the first non-conductive structure 410 with the second non-conductive structure 430 can be avoided. The antenna radiator may be formed through an LDS method or an IMA method.

When space permits, the antenna radiator may be inserted into the first surface of the first non-conductive structure through an insert molding method in which a thin metal plate is exposed or non-exposed. The antenna radiator may be formed through a method of attaching a metal tape to the first surface of the first non-conductive structure. The antenna radiator may be formed through a method of spray-coating a conductive material on the first surface of the first non-conductive structure.

In step 705, a housing is manufactured by injection molding the second non-conductive structure on the first non-conductive structure. For example, a housing for an electronic device may be manufactured through the in-mold injection molding of the first non-conductive structure including an antenna radiator and the second non-conductive structure. The housing may serve as the exterior of the electronic device. The housing may serve as an internal housing of the electronic device. According to another embodiment, at least one conductive connection part may be formed on the first non-conductive structure in order to extend the antenna radiator to the second surface of the first non-conductive structure not to overlap with the boundary with the second non-conductive structure.

The antenna radiator may be formed in at least a portion of one or more exposure regions 413 and 414 that do not interfere with the second non-conductive structure 430. Conductive press-fit pins 541, 542, and 543 may be inserted into one or more conductive connection parts, respectively.

In step 707, a pattern region is masked. For example, at least a portion of the housing may be masked. The masking may be performed including the antenna radiator region of the first non-conductive structure. As another example, the antenna radiator region of the first non-conductive structure may be masked in order to perform deposition on at least a portion of the second non-conductive structure (e.g., the portion serving as the side surface of the housing), except for the side surface of the housing (i.e., the first non-conductive structure). Besides the masking operation, taping, wrapping or the same operation using a masking jig may also be performed.

In step 709, deposition is performed on at least a partial region of the exterior of the housing, such as the side surface of the housing. The external appearance of the housing may be made more visually appealing through the deposition process. A process other than the deposition process, such as painting or coating, may be performed. The painting or coating may be performed after the deposition process, which may be performed on the housing region, excluding the antenna radiator region.

In step 710, the masking region is removed.

In step 711, post-treatment is performed. The post-treatment process includes taping or painting the remaining portion of the housing.

According to various embodiments, there may be provided an electronic device including: an external housing that includes a first non-conductive structure including a first face that faces in a first direction and a second face that faces in a second direction that is opposite to the first direction and a second non-conductive structure formed integrally with a portion of the first non-conductive structure, and forming at least a portion of a third face that faces in a third direction that is different from the first direction and the second direction; a first conductive pattern formed to be in contact with the first face of the first non-conductive structure; a second conductive pattern formed to be in contact with the second face of the first non-conductive structure; a conductive connection part configured to electrically interconnect the first conductive pattern and the second conductive pattern; and a communication circuit configured to use at least a portion of the first conductive pattern, the second conductive pattern, and the conductive connection part as a radiation pattern. The second non-conductive structure, which forms at least a portion of the third face, includes an external layer of a material that is different from the first non-conductive structure and the second non-conductive structure, and the second non-conductive structure does not at least partially overlap with the first conductive pattern or the second conductive pattern when viewed from above the first face.

According to various embodiments, the conductive connection part may be formed to electrically interconnect the first conductive pattern and the second conductive pattern through a hole that penetrates a first portion.

According to various embodiments, the electronic device may include a third conductive pattern electrically connected to the second conductive pattern. The third conductive pattern may be formed to be in contact with the third face extending to face in the third direction from the second face of the first non-conductive structure.

According to various embodiments, there is provided an electronic device including a housing. The housing may include: a first non-conductive structure including a first face and a side face having a height in at least a partial region along a rim of the first face; a conductive pattern disposed to extend from the first face of the first non-conductive structure to at least a partial region of the second face that is opposite to the first face; and a second non-conductive structure formed on the first non-conductive structure through in-mold injection molding. The conductive pattern may extend to the second face without overlapping with a boundary with the second non-conductive structure.

According to various embodiments, the conductive pattern may extend through at least one conductive connection part that is formed from the first face of the first non-conductive structure to the second face.

According to various embodiments, a press-fit pin 541 made of a conductive material may be inserted into the at least one conductive connection part.

According to various embodiments, the conductive pattern may extend to the second face without overlapping with a boundary with the second non-conductive structure.

According to various embodiments, the conductive pattern may be formed to extend to the second face and the third face of the first non-conductive structure.

According to various embodiments, the conductive pattern may be formed on the first non-conductive structure through one or more methods that are selected from a Laser Direct Structuring (LDS) method, an In-Mold Antenna (IMA) method, an insert molding method in which a thin metal plate is exposed to or not exposed to the first face of the first non-conductive structure, a method of attaching a metal tape to the first face of the first non-conductive structure, and a method of spray coating a conductive material on the first face of the first non-conductive structure.

According to various embodiments, the first non-conductive structure and the second non-conductive structure may be made of different kinds of materials, respectively.

According to various embodiments, the housing may serve as an internal housing of the electronic device or an external housing that forms an external appearance.

According to various embodiments, there is provided a method of manufacturing a housing. The method may include: forming a conductive pattern on a first non-conductive structure; injection molding a second non-conductive structure on the first non-conductive structure; masking a region including the conductive pattern; performing deposition on at least a partial region of the second non-conductive structure; and removing the masking region and performing post-treatment. The conductive pattern may extend to the second face of the first non-conductive structure without overlapping with a boundary with the second non-conductive structure.

According to various embodiments, the method may further include forming at least one conductive connection part from the first face to the second face of the first non-conductive structure. The conductive pattern may extend through the conductive connection part.

According to various embodiments, the method may further include inserting a conductive press-fit pin into the conductive connection part.

According to various embodiments, the conductive pattern may be formed to extend to the second face of the first non-conductive structure and the third face that extends from the second face.

According to various embodiments, the conductive pattern may be formed to extend to an exposure region where the first non-conductive structure is exposed to an opened portion of the second non-conductive structure after in-mold injection molding.

According to various embodiments, the first non-conductive structure and the second non-conductive structure may be made using different kinds of materials, respectively.

According to various embodiments, the housing may serve as an internal housing of the electronic device or an external housing that forms an external appearance.

In the case of in-mold injection molding by injection molded products of different types of materials, the antenna pattern formed on the first non-conductive structure is not configured not to overlap with a side surface of the second non-conductive structure or a boundary portion with the second non-conductive structure. Therefore, it is possible to prevent the antenna pattern from being cracked or lost by the injection molded products of the different types of materials. Since the region, in which exterior deposition is disabled due to a contact with a chemical substance in the process of plating the antenna pattern, is minimized, a deposition process can be smoothly performed on the exterior of the housing, and as a result, it is possible to ensure the reliability of the electronic device and to obtain a visually enhanced appearance.

Figure 8:
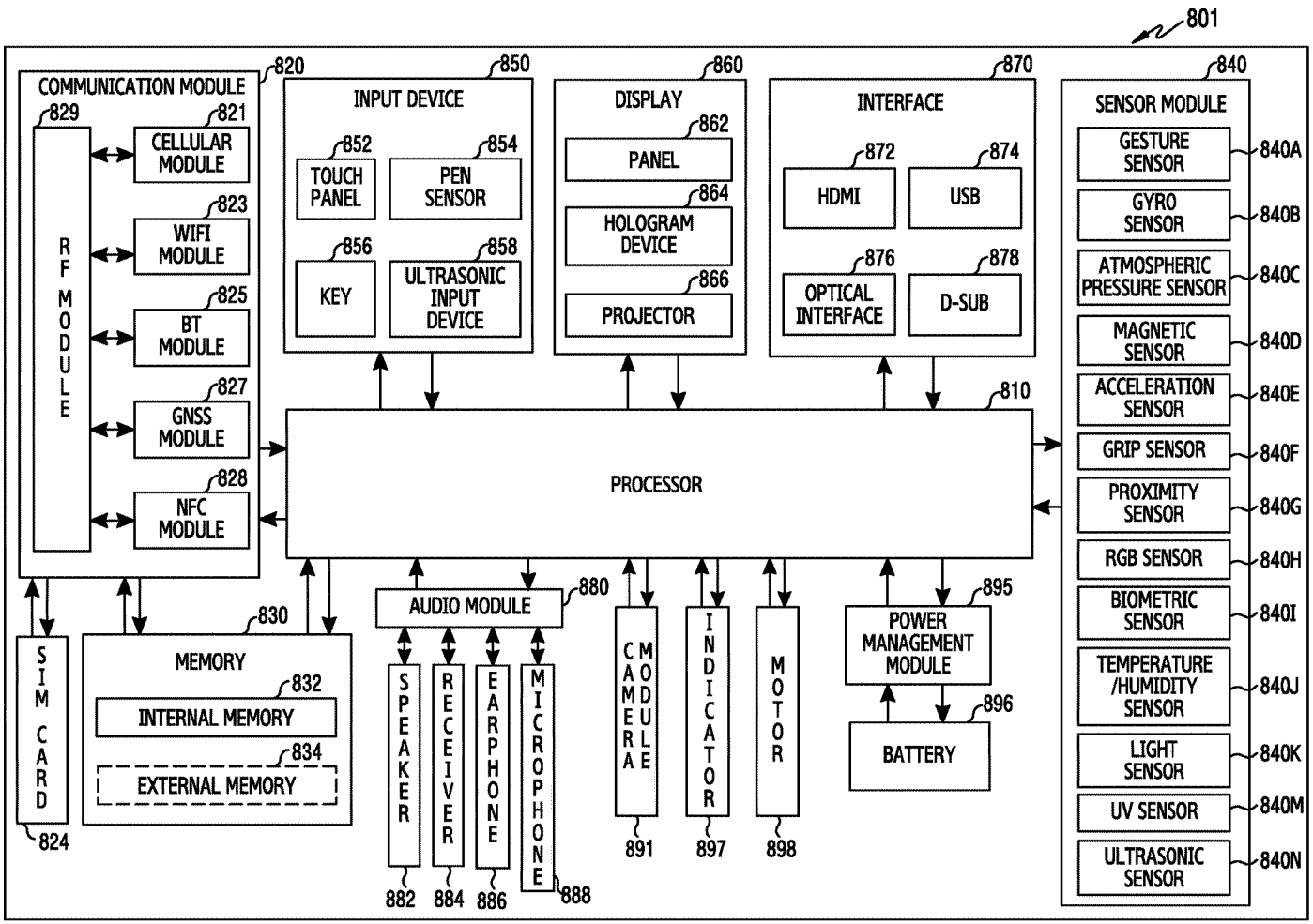
FIG. 8 is a block diagram of an electronic device according to embodiments of the present disclosure.

FIG. 8 is a block diagram illustrating an electronic device according to embodiments of the present disclosure.

Referring to FIG. 8, the electronic device 801 may, for example, correspond to the entire electronic device 101 shown in FIG. 1 or a part thereof. Referring to FIG. 8, the electronic device 801 includes at least one application processor (AP) 810, a communication module 820, a subscriber identity module (SIM) card 824, a memory 830, a sensor module 840, an input device 850, a display 860, an interface 870, an audio module 880, a camera module 891, a power management module 895, a battery 896, an indicator 897, and a motor 898.

The AP 810 controls a plurality of hardware or software elements connected to the AP 810 by driving an operating system or an application program and process various types of data including multimedia data and perform calculations. The AP 810 may be implemented as, for example, a system on chip (SoC). According to an embodiment, the AP 810 may further include a graphic processing unit (GPU).

The communication module 820 interface performs data transmission/reception in communication between the electronic device 801 and other electronic devices, such as the electronic device 104 and the server 106 connected thereto through a network. The communication module 820 includes a cellular module 821, a Wi-Fi module 823, a Bluetooth® (BT) module 825, a GNSS module 827, a near field communication (NFC) module 828, and a radio frequency (RF) module 829.

The cellular module 821 provides a voice call, a video call, a text message service, or an Internet service through a communication network, such as LTE, LTE-A, CDMA, WCDMA, UMTS, WiBro, or GSM. Furthermore, the cellular module 821 may distinguish and authenticate electronic devices within a communication network, for example, using the SIM card 824. According to an embodiment, the cellular module 821 performs at least some functions which the AP 810 provides. For example, the cellular module 821 performs at least some of the multimedia control functions.

According to an embodiment, the cellular module 821 includes a communication processor (CP). In addition, the cellular module 821 may be implemented by, for example, a SoC. Although the elements such as the cellular module 821, the memory 830, and the power management module 895 are illustrated as separate elements from the AP 810 in FIG. 8, according to an embodiment, the AP 810 may be implemented so as to include at least some of the above elements, such as the cellular module 821.

According to an embodiment, the AP 810 or the cellular module 821 may load a command or data received from at least one of a non-volatile memory and other components connected thereto in a volatile memory, and processes the loaded command or data. Also, the AP 810 or the cellular module 821 stores, in a non-volatile memory, data received from or generated by at least one of other elements.

The Wi-Fi module 823, the BT module 825, the GPS module 827, and the NFC module 828 include, for example, a processor for processing data transmitted/received through a corresponding module. Although the cellular module 821, the WiFi module 823, the BT module 825, the GPS module 827, and the NFC module 828 are illustrated as separate blocks in FIG. 8, at least two of these modules may be included in one integrated chip (IC) or one IC package. For example, at least some of the processors corresponding to the cellular module 821, the WiFi module 823, the BT module 825, the GPS module 827, and the NFC module 828 may be implemented as one SoC.

The RF module 829 transmits/receives data, for example, an RF signal. Although not illustrated in the drawing, the RF module 829 may, for example, include a transceiver, a power amp module (PAM), a frequency filter, or a low noise amplifier (LNA). The RF module 829 may further include a component for transmitting/receiving electronic waves over a free air space in wireless communication, for example, a conductor, a conducting wire or the like. Although the cellular module 821, the WiFi module 823, the BT module 825, the GPS module 827, and the NFC module 828 share one RF module 829 in FIG. 8, at least one of these modules transmits/receives an RF signal through a separate RF module in an alternate embodiment.

The SIM card 824 includes a SIM, and may be inserted into a slot formed in a particular portion of the electronic device. The SIM card 824 includes unique identification information, such as an integrated circuit card identifier (ICCID) or subscriber information, such as an international mobile subscriber identity (IMSI).

The memory 830 includes an internal memory 832 or an external memory 834. The internal memory 832 includes, for example, at least one of a volatile memory, such as a dynamic random access memory (DRAM), a static RAM (SRAM), and a synchronous dynamic RAM (SDRAM), and a non-volatile memory, such as a one-time programmable ROM (OTPROM), a programmable ROM (PROM), an erasable and programmable ROM (EPROM), an electrically erasable and programmable ROM (EEPROM), a mask ROM, a flash ROM, a NAND flash memory, and an NOR flash memory.

According to an embodiment, the internal memory 832 may be a solid state drive (SSD). The external memory 834 may further include a flash drive, for example, a compact flash (CF), a secure digital (SD), a micro secure digital (Micro-SD), a mini secure digital (Mini-SD), an extreme digital (xD), or a memory stick. The external memory 834 may be functionally connected to the electronic device 801 through various interfaces. The electronic device 801 may further include a storage device (or storage medium) such as a hard drive.

The sensor module 840 measures a physical quantity or detect an operation state of the electronic device 801, and may convert the measured or detected information to an electrical signal. The sensor module 840 includes at least one of, for example, a gesture sensor 840A, a gyro sensor 840B, an atmospheric pressure sensor 840C, a magnetic sensor 840D, an acceleration sensor 840E, a grip sensor 840F, a proximity sensor 840G, a color sensor 840H, such as a red/green/blue (RGB) sensor, a bio-sensor 840I, a temperature/humidity sensor 840J, an illumination sensor 840K, and an ultraviolet (UV) sensor 840M. Additionally or alternatively, the sensor module 840 includes, for example, an E-nose sensor, an electromyography (EMG) sensor, an electroencephalogram (EEG) sensor, an electrocardiogram (ECG) sensor, an Infrared (IR) sensor, an iris sensor, and a fingerprint sensor. The sensor module 840 may further include a control circuit for controlling one or more sensors included in the sensor module 840.

The input device 850 includes a touch panel 852, a (digital) pen sensor 854, a key 856, or an ultrasonic input device 858. The touch panel 852 may recognize a touch input in at least one of, for example, a capacitive scheme, a resistive scheme, an infrared scheme, and an acoustic wave scheme. The touch panel 852 may further include a control circuit. A capacitive touch panel may recognize a physical contact or proximity. The touch panel 852 may further include a tactile layer. In this event, the touch panel 852 provides a tactile response to the user.

The (digital) pen sensor 854 may be embodied, for example, using a method identical or similar to a method of receiving a touch input from a user, or using a separate recognition sheet. The key 856 includes, for example, a physical button, an optical key, or a keypad. The ultrasonic input device 858 may identify data by detecting an acoustic wave with a microphone 888 of the electronic device 801, through an input unit generating an ultrasonic signal, and performs wireless recognition. According to an embodiment, the electronic device 801 receives a user input from an external device connected thereto using the communication module 820.

The display 860 includes a panel 862, a hologram device 864, or a projector 866. The panel 862 may be, for example, a liquid crystal display (LCD) and an active matrix organic light emitting diode (AM-OLED) display. The panel 862 may be implemented to be, for example, flexible, transparent, or wearable. The panel 862 includes the touch panel 852 and one module. The hologram device 864 may show a stereoscopic image in the air by using interference of light. The projector 866 may project light onto a screen to display an image. The screen may be located, for example, inside or outside the electronic device 801. The display 860 may further include a control circuit for controlling the panel 862, the hologram device 864, or the projector 866.

The interface 870 includes, for example, a high-definition multimedia interface (HDMI) 872, a universal serial bus (USB) 874, an optical interface 876, or a d-subminiature (D-sub) 878. The interface 870 may be included in, for example, the communication interface 160 illustrated in FIG. 1. Additionally or alternatively, the interface 870 includes, for example, a mobile high-definition link (MHL) interface, a secure digital (SD) card/multi-media card (MMC) interface, or an infrared data association (IrDA) standard interface.

The audio module 880 may bilaterally convert a sound and an electrical signal. At least some components of the audio module 880 may be included in, for example, the input/output interface 140 illustrated in FIG. 1. The audio module 880 processes sound information input or output through, for example, the speaker 882, the receiver 884, the earphones 886, the microphone 888 or the like.

The camera module 891 captures a still image or a video, and according to an embodiment, includes one or more image sensors such as a front sensor and a rear sensor, a lens, an image signal processor (ISP), or a flash such as an LED or xenon lamp.

The power management module 895 may manage the power usage of the electronic device 801. The power management module 895 includes, for example, a power management integrated circuit (PMIC), a charger integrated circuit (IC), or a battery gauge.

The PMIC may be mounted to, for example, an integrated circuit or a SoC semiconductor. Charging methods may be classified into a wired charging method and a wireless charging method. The charger IC may charge a battery and may prevent an overvoltage or excess current from being induced or flowing from a charger, and includes a charger IC for at least one of the wired charging method and the wireless charging method. A magnetic resonance scheme, a magnetic induction scheme, or an electromagnetic scheme may be exemplified as the wireless charging method, and an additional circuit for wireless charging, such as a coil loop circuit, a resonance circuit, a rectifier circuit, and the like may be added.

The battery gauge measures, for example, a remaining quantity of the battery 896, or a voltage, a current, or a temperature during charging. The battery 896 stores or generate electricity, and supplies power to the electronic device 801 by using the stored or generated electricity. The battery 896 includes, for example, a rechargeable battery or a solar battery.

The indicator 897 may display a specific status of the electronic device 801 or a part of electronic device, such as a booting, message, or charging status. The motor 898 can convert an electrical signal into a mechanical vibration. The electronic device 801 includes a GPU for supporting a mobile TV. The processing device for supporting mobile TV processes media data according to a standard of digital multimedia broadcasting (DMB), digital video broadcasting (DVB), or media flow.

Each of the above-described elements of the electronic device according to embodiments of the present disclosure includes one or more components, and the name of a corresponding element may vary according to the type of electronic device. The electronic device according to embodiments of the present disclosure includes at least one of the above-described elements, and may exclude some of the elements or further include other additional elements. Further, some of the components of the electronic device according to the embodiments of the present disclosure may be combined to form a single entity, and thus, may equivalently execute functions of the corresponding elements prior to the combination.

The "module" used in embodiments of the present disclosure may refer to, for example, a "unit" including one of hardware, software, and firmware, or a combination of two or more of the hardware, software, and firmware. The "module" may be interchangeable with expressions such as a unit, a logic, a logical block, a component, or a circuit. The "module" may be a minimum unit of an integrated component element or a part thereof. The "module" may be the smallest unit that performs one or more functions or a part thereof. The "module" may be mechanically or electronically implemented. For example, the "module" according to embodiments of the present disclosure includes at least one of an application-specific integrated circuit (ASIC) chip, a field-programmable gate arrays (FPGAs), and a programmable-logic device for performing operations which have been known or are to be developed hereafter.

At least some modules or functions of the devices described herein or methods according to the embodiments of the present disclosure may be implemented as, for example, instructions stored computer readable storage media in the form of programming modules. When the command is executed by one or more processors, the one or more processors may execute a function corresponding to the command. The computer-readable storage medium may be, for example, the memory 220. At least a part of the programming module may be implemented by, for example, the processor 810. At least some of the programming modules include, for example, a module, a program, a routine, a set of instructions or a process for performing one or more functions.

The computer readable recording medium may include magnetic media such as a hard disc, a floppy disc, and a magnetic tape, optical media such as a compact disc read-only memory (CD-ROM) and a digital versatile disc (DVD), magneto-optical media such as a floptical disk, and hardware devices specifically configured to store and execute program commands, such as a ROM, a RAM, and a flash memory. In addition, the program instructions may include high-class language codes, which can be executed by a computer by using an interpreter, as well as machine codes made by a compiler. The aforementioned hardware device may be configured to operate as one or more software modules in order to perform the operation of embodiments of the present disclosure, and vice versa.

A module or a programming module according to embodiments of the present disclosure may include at least one of the above-described elements, may exclude some of the elements, or may further include other additional elements. Operations executed by a module, a programming module, or other component elements according to embodiments of the present disclosure may be executed sequentially, in parallel, repeatedly, or in a heuristic manner. Further, some operations may be executed according to another order or may be omitted, or other operations may be added.

The above-described aspects of the present disclosure can be implemented in hardware, firmware or via the execution of software or computer code that can be stored in a recording medium such as a CD-ROM, a digital versatile disc (DVD), a magnetic tape, a RAM, a floppy disk, a hard disk, or a magneto-optical disk or computer code downloaded over a network originally stored on a remote recording medium or a non-transitory machine-readable medium and to be stored on a local recording medium, so that the methods described herein can be rendered via such software that is stored on the recording medium using a general purpose computer, or a special processor or in programmable or dedicated hardware, such as an ASIC or FPGA.

As would be understood in the art, the computer, the processor, microprocessor controller or the programmable hardware include memory components, e.g., RAM, ROM, Flash, etc. that stores or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, software or a combination of both and may be performed in whole or in part within the programmed instructions of a computer.

While the present disclosure has been particularly shown and described with reference to the examples provided therein, it will be understood by those skilled in the art that various changes in form and details may be made therein without departing from the spirit and scope of the present disclosure as defined by the appended claims.

What is claimed is:

1. An electronic device comprising:

a housing that includes:

a first non-conductive structure including a first surface that surfaces in a first direction and a second surface that surfaces in a second direction that is opposite to the first direction; and a second non-conductive structure formed integrally with a portion of the first non-conductive structure, and forming at least a portion of a third surface that surfaces in a third direction that is different from the first direction and the second direction;

a first conductive pattern formed to be in physical contact with the first surface of the first non-conductive structure;

a second conductive pattern formed to be in physical contact with the second surface of the first non-conductive structure;

a third conductive pattern electrically connected to the second conductive pattern;

at least one conductive connection part that electrically interconnects the first conductive pattern and the second conductive pattern; and a communication circuit that uses at least a portion of the first conductive pattern, the second conductive pattern, the third conductive pattern, and the conductive connection part as a radiation pattern, wherein the second non-conductive structure does not overlap with the first conductive pattern or the second conductive pattern when viewed from above the first surface, and wherein the third conductive pattern is formed to be in physical contact with the third surface extending to surface in the third direction from the second surface of the first non-conductive structure.

2. The electronic device of claim 1, wherein the at least one conductive connection part is formed to electrically interconnect the first conductive pattern and the second conductive pattern by penetrating the first non-conductive structure.

3. The electronic device of claim 1, further comprising:

a press-fit pin inserted into the at least one conductive connection part.

4. The electronic device of claim 1, wherein the housing serves as an internal housing of the electronic device or an external housing that forms an external appearance.

* * * * *